US007116288B2

(12) United States Patent
Shiizaki et al.

(10) Patent No.: US 7,116,288 B2
(45) Date of Patent: Oct. 3, 2006

(54) DRIVING METHOD OF PLASMA DISPLAY PANEL AND DISPLAY DEVICE

(75) Inventors: Takashi Shiizaki, Kawasaki (JP); Hitoshi Hirakawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 246 days.

(21) Appl. No.: 09/885,001

(22) Filed: Jun. 21, 2001

(65) Prior Publication Data

US 2002/0105485 A1 Aug. 8, 2002

(30) Foreign Application Priority Data

Feb. 7, 2001 (JP) ..... 2001-030516

(51) Int. Cl.
*G09G 3/28* (2006.01)

(52) U.S. Cl. ..... 345/60; 345/67; 345/68; 315/169.4

(58) Field of Classification Search ..... 345/60, 345/61, 62, 63, 66, 67, 68; 315/169.4
See application file for complete search history.

(56) References Cited

U.S. PATENT DOCUMENTS

| | | | | |
|---|---|---|---|---|
| 6,072,449 | A | 6/2000 | Amemiya | |
| 6,084,558 | A | 7/2000 | Setoguchi et al. | |
| 6,144,349 | A * | 11/2000 | Awata et al. | 345/67 |
| 6,275,203 | B1 | 8/2001 | Yamada | |
| 6,320,326 | B1 * | 11/2001 | Shino et al. | 315/169.4 |
| 6,342,873 | B1 * | 1/2002 | Ueoka et al. | 345/60 |
| 6,344,841 | B1 * | 2/2002 | Moon | 345/60 |
| 6,380,912 | B1 * | 4/2002 | Kang et al. | 345/60 |
| 6,489,722 | B1 * | 12/2002 | Yoshida et al. | 313/582 |
| 6,504,519 | B1 * | 1/2003 | Ryu et al. | 345/60 |
| 2001/0024092 | A1 * | 9/2001 | Kim et al. | 315/169.4 |
| 2002/0039086 | A1 * | 4/2002 | Hirakawa et al. | 345/60 |

FOREIGN PATENT DOCUMENTS

| | | |
|---|---|---|
| JP | 10-003280 | 1/1998 |
| JP | 10-247072 | 9/1998 |
| JP | 11-38931 | 2/1999 |
| JP | 11-327505 | 11/1999 |
| JP | 2000-284746 | 10/2000 |
| JP | 2000-293137 | 10/2000 |

OTHER PUBLICATIONS

Official Communication from the Japanese Patent Office dated Mar. 15, 2005.

* cited by examiner

*Primary Examiner*—Xiao Wu
(74) *Attorney, Agent, or Firm*—Staas & Halsey LLP

(57) ABSTRACT

A driving method of a plasma display panel having a display electrodes arranged at the ratio of three per two rows is provided, in which all rows are lighted in sustaining period from an addressing period to the next addressing period and electromagnetic interference is reduced sufficiently. A display discharge is generated by controlling potentials of the display electrodes so as to satisfy two conditions. One condition is that there is a pair of display electrodes having terminals at the same side of the display screen and current directions opposite to each other. Another condition is to generate a potential difference across the display electrodes, which is necessary for discharging. Magnetic fields are canceled by each other in the pair of electrodes having current directions opposite to each other, so that electromagnetic interference is reduced.

12 Claims, 19 Drawing Sheets

DRIVING METHOD OF PLASMA DISPLAY PANEL AND DISPLAY DEVICE

BACKGROUND OF THE INVENTION

1. Field of the Invention

The present invention relates to a driving method of a surface discharge type plasma display panel (PDP).

A PDP is commercialized as a wall-hung television set or a monitor of a computer, and the screen size thereof has reached 60 inches. In addition, a PDP is a digital display device comprising binary light emission cells and is suitable for displaying digital data, so it is expected as a multimedia monitor. In a market, a device having high resolution supporting a high quality digital image and being capable of displaying a bright image is desired.

2. Description of the Prior Art

In an AC type PDP, charge quantity (wall charge quantity) of a dielectric layer is controlled in accordance with contents of display in an addressing period, and then the wall charge is used for generating a display discharge plural times corresponding to a luminance value in a sustaining period. In the sustaining period, a sustaining voltage Vs having alternating polarities is applied across a pair of display electrodes. The sustaining voltage Vs satisfies the following inequality (1).

$$Vf_{XY}-Vw_{XY}<Vs<Vf_{XY} \quad (1)$$

Here, $Vf_{xy}$ is a discharge start voltage between the display electrodes, and $Vw_{xy}$ is a wall voltage between the display electrodes. The application of the sustaining voltage Vs causes a display discharge only in cells having predetermined quantity of wall charge when a cell voltage (a sum of a drive voltage applied to the electrodes and the wall voltage) exceeds the discharge start voltage $Vf_{xy}$. Since a usual application period is short such as a few microseconds, the light emission can be seen continuously.

A surface discharge format is adopted in an AC type PDP for a color display. In this surface discharge format, display electrodes to be an anode and a cathode in the display discharge are arranged in parallel on a front or rear substrate, and address electrodes are arranged in such a way to cross the display electrode pair. Also in the surface discharge type PDP, the display electrodes are connected with driving circuits by distributing display electrode terminals alternately in both sides (e.g., right and left sides) of a display screen in the order of electrode arrangement, as a usual method.

There are two forms of arrangement of the display electrodes for the surface discharge type. Hereinafter, one form is referred to as Form A and another form is referred to as Form B. In Form A, a pair of display electrodes is arranged for each row. The total number of the display electrodes is twice the number of rows n. In Form A, each row is independent of other rows when being controlled, so there is large flexibility of driving sequence. However, since an electrode gap between neighboring rows (also called a reverse slit) becomes a non-lighted area, utilization factor of the display screen is small. In Form B, display electrodes of the number of rows n plus one are arranged substantially at a constant pitch at the ratio of three per two rows. In Form B, neighboring display electrodes constitute an electrode pair for a surface discharge, and every display electrode gap becomes a surface discharge gap. Display electrodes except both ends of the arrangement relates to displays of an odd row and an even row. This Form B has an advantage from the viewpoints of high definition (a small row pitch), an efficient use of the display screen, and high resolution (increase of rows).

Conventionally, a PDP having an electrode structure of Form B is used for a display of an interlace format. In the interlace format, a half of rows in the entire screen is not used in each of odd and even fields. For example, even-numbered rows are not lighted in an odd field. Therefore, luminance in the interlace format is lower than that in the progressive format. In addition, the interlace format has another disadvantage in that flickers are conspicuous in a display of a still picture. The progressive format is suitable for a high quality display that is required for high quality image equipment such as a DVD or a HDTV.

If an appropriate addressing is performed for a PDP of Form B, a display of the progressive format can be realized. Namely, when a sustaining voltage Vs having alternating polarities is applied across the display electrodes in the same way as in the PDP of Form A, an odd row and an even row can be lighted at the same time. However, if the usual driving method is applied as it is, in which the neighboring display electrodes are biased alternately, directions of current flowing through the display electrodes upon the display discharge become the same in all display electrodes. When the directions of the current are the same, magnetic fields generated when electricity is supplied are strengthened by each other, resulting in a problem of EMI (electromagnetic interference) between the display screen and external equipment.

A driving method that is effective at reducing the electromagnetic interference in a PDP of Form A is disclosed in Japanese unexamined patent publication No. 10-3280. As disclosed in this publication, in the case of Form A, display electrodes to be biased are divided into right and left in such a way that a display electrode having a terminal at the left side of the display screen is biased in an odd row, while another display electrode having a terminal at the right side is biased in an even row, so that the direction of current in the odd row becomes opposite to that in the even row. When the directions of current are opposite to each other, magnetic fields are canceled by each other. If an image to be displayed has the same number of lighted cells between neighboring rows, the magnetic fields are completely canceled by each other. However, this conventional technique cannot be applied to a PDP of Form B, because neighboring odd and even rows share a display electrode in Form B, so that the direction of current cannot be set independently for each row.

SUMMARY OF THE INVENTION

An object of the present invention is to provide a driving method of a display having a PDP in which display electrodes are arranged at a ratio of three per two rows, wherein all rows can be lighted in sustaining period from an addressing period to the next addressing period and electromagnetic interference can be reduced sufficiently.

According to one embodiment of the present invention, driving waveforms are set so as to satisfy the following two conditions.

Condition 1: Each display electrode has another display electrode that has a terminal at the same side of the display screen and has the opposite direction of current.

Condition 2: A potential difference is generated across the display electrodes, which is necessary for a discharge.

Namely, plural electrode pairs are set by dividing the first display electrodes by two having terminals at one side of the display screen. In the same manner, about the second display electrodes having terminals at the other side of the display screen, plural electrode pairs are set, so that the potential changes have a complementary relationship between the first display electrodes as well as between the second display electrodes making electrode pairs. Then, a sustaining voltage is applied across the display electrodes at the ratio of one row per k ($k \geqq 2$) rows, and the potentials of the first display electrodes and the second display electrodes are changed so that the interelectrodes to which the sustaining voltage is applied are changed sequentially. Magnetic fields are cancelled by each other between the display electrodes making a pair, so that the electromagnetic interference can be reduced.

Alternatively, terminals for supplying electricity to the first display electrodes and terminals for supplying electricity to the second display electrodes are arranged at one side of the display screen, and the sustaining voltage pulse is applied to the first display electrodes and the second display electrodes alternately.

DESCRIPTION OF THE PREFERRED EMBODIMENTS

Hereinafter, the present invention will be explained more in detail with reference to embodiments and drawings.

[First Embodiment]

A structure of a device to which a driving method of the present invention is applied will be explained, and then the driving method will be explained. A sustaining control that is a feature of the driving method of the present invention as well as an addressing control that relates to a practice of the present invention will be explained in detail.

[Device Structure]

Figure 1:
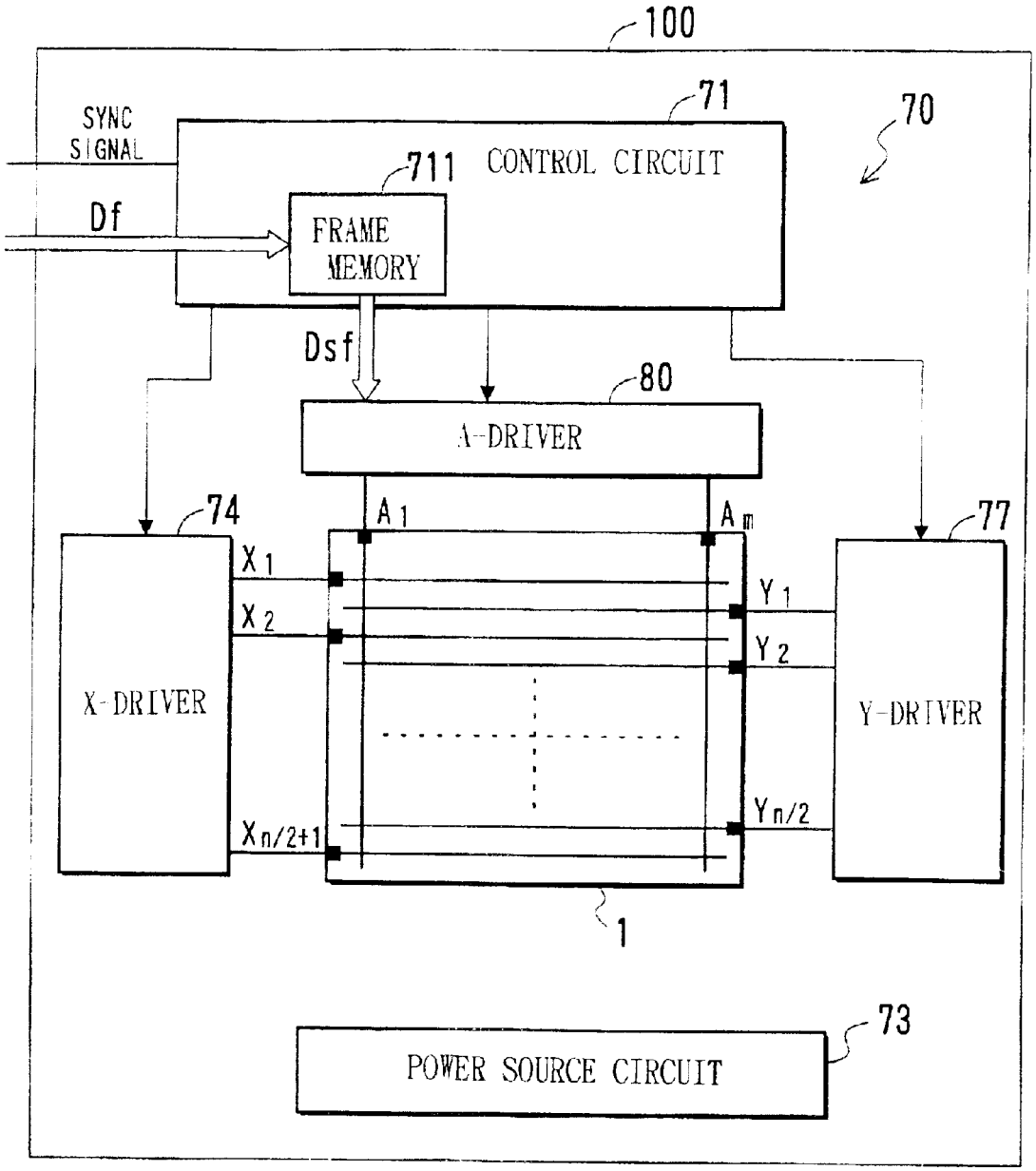
FIG. 1 is a block diagram of a display device according to a first embodiment of the present invention.

FIG. 1 is a block diagram of a display device according to a first embodiment of the present invention. A suffix of a reference character in FIG. 1 indicates an arrangement order of the corresponding electrode. A display device 100 comprises a surface discharge type PDP 1 having a display screen including m×n cells for a color display and a drive unit 70 for controlling light emission of cells. The display device 100 is used for a wall-hung television set or a monitor of a computer system.

In the PDP 1, first and second display electrodes X and Y for generating display discharges are arranged in parallel and in the order of X, Y, X, . . . , Y, X while address electrodes A are arranged to cross the display electrodes X and Y. The display electrodes X and Y extend in the row direction (horizontal direction) of a matrix display, while the address electrodes extend in the column direction (vertical direction). The total number of the display electrodes X and Y is the number of rows n plus one (n+1), while the total number of the address electrodes A is equal to the number of columns m. In this embodiment the number of rows n is even. Terminals of the display electrodes X are arranged at one side of the display screen in the row direction, while terminals of the display electrodes Y are arranged in the other side.

The drive unit 70 includes a control circuit 71 for controlling drive, a power source circuit 73 for supplying a driving power, an X driver 74 for controlling potentials of the display electrodes X, a Y-driver 77 for controlling potentials of the display electrodes Y, and an A-driver 80 for controlling potentials of the address electrodes A. The drive unit 70 is supplied with frame data Df indicating luminance levels of red, green and blue colors together with various synchronizing signals from external equipment such as a TV tuner or a computer. The frame data Df are temporarily memorized in a frame memory 711 of the control circuit 71. The control circuit 71 converts the frame data Df into subfield data Dsf for a gradation display, which are transmitted to the A-driver 80 in series. The subfield data Dsf are a set of display data in which each bit corresponds to one cell. A value of the each bit indicates whether the cell is lighted or not in the corresponding subfield, more specifically whether an address discharge is necessary or not.

[Panel Structure]

Figure 2:
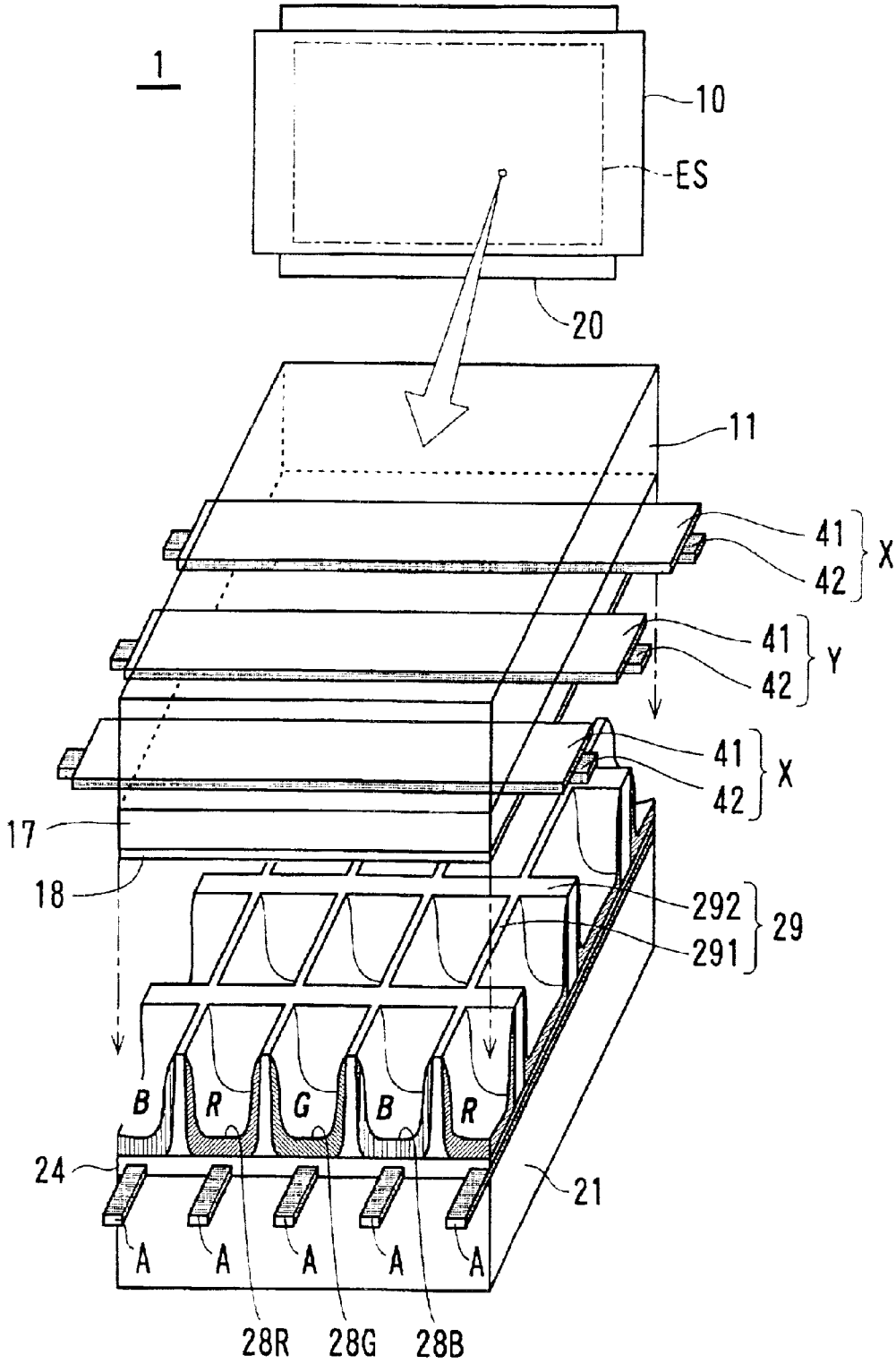
FIG. 2 is a perspective view showing a cell structure of a PDP.

FIG. 2 is a perspective view showing a cell structure of a PDP. PDP 1 comprises a pair of substrate structures 10 and 20, each of which includes a substrate on which cell elements are arranged. On the inner surface of a glass substrate 11 of the front substrate structure 10, the display electrodes X and Y are arranged at the row pitch. Here, the row means a set of m (the number of columns) cells having the same arrangement order in the column direction. Each of the display electrodes X and Y includes a transparent conductive film 41 forming a surface discharge gap of each cell and a metal film (bus conductor) 42 that is overlaid on the middle of the transparent conductive film 41 in the column direction. The metal film 42 is drawn out of a display screen ES and is connected to the corresponding driver. The display electrodes X and Y are covered with a dielectric layer 17, which is coated with magnesia (MgO) forming a protection film 18. On the inner side of a glass substrate 21 of the rear substrate structure 20, the address electrodes A are arranged one by one corresponding to each column. The address electrodes A are covered with a dielectric layer 24, on which a partition 29 having a height of approximately 150 μm is provided. The partition 29 includes a portion dividing a discharge space into columns (hereinafter referred to as a vertical wall) 291 and a portion dividing the discharge space into rows (hereinafter referred to as a horizontal wall) 292. The surface of the dielectric layer 24 and a side face of the partition 29 are covered with red, green and blue fluorescent material layers 28R, 28G and 28B for a color display. Italic letters (R, G and B) in FIG. 2 indicate light emission colors of the fluorescent material layers. The color arrangement has a repeating pattern of red, green and blue colors, in which cells of one column have the same color. A discharge gas emits ultraviolet rays, which excite the fluorescent material layers 28R, 28G and 28B to emit light.

Figure 3:
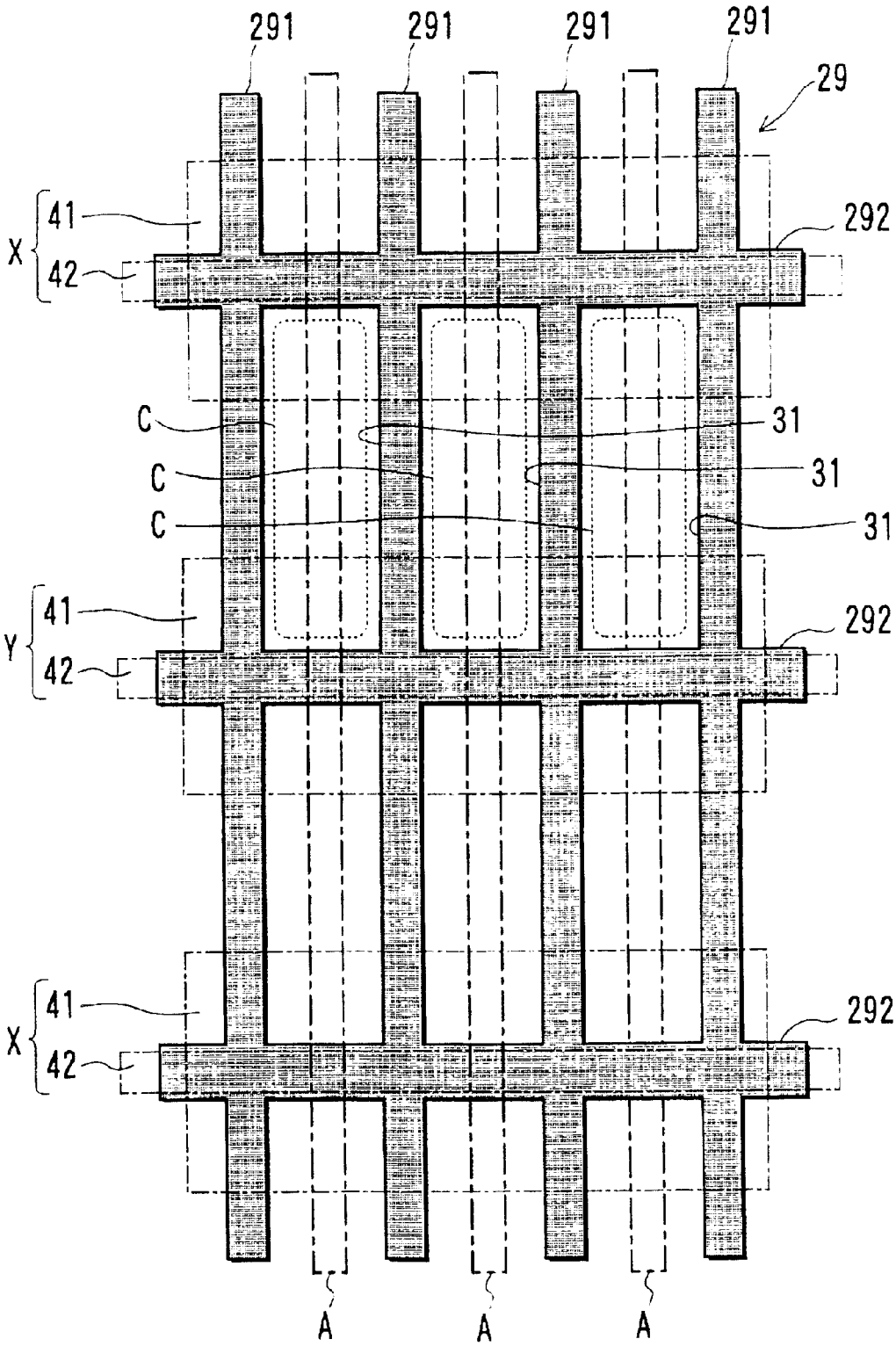
FIG. 3 is a plan view showing a partition pattern of a PDP.

FIG. 3 is a plan view showing a partition pattern of a PDP. The partition has a grid pattern in which each cell C is enclosed separately. Since a discharge space 31 is substantially divided into cells in the grid pattern, there is no discharge interference in the column direction in contrast to a stripe pattern in which horizontal walls are omitted. Furthermore, by providing fluorescent material at a side face of the horizontal wall 292 too, light emission efficiency is enhanced. If the metal films 42 of the display electrodes X and Y are arranged to overlap the horizontal wall 292, it can be avoided to shield display light by the metal film 42.

[Driving Method]

Figure 4:
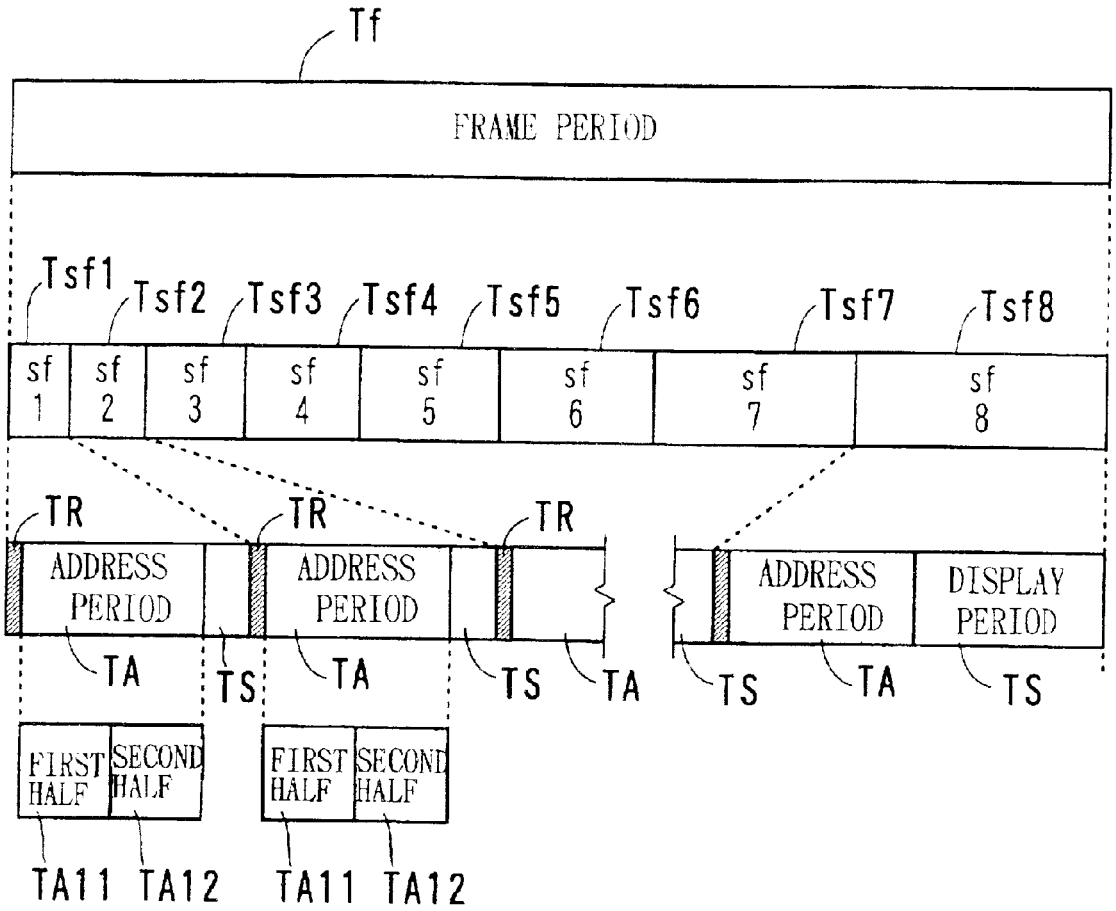
FIG. 4 is a diagram showing a general setting of periods.

FIG. 4 is a diagram showing a general setting of periods. A frame that is image information of one scene is displayed in the progressive format in a frame period Tf. The frame is divided into e.g., eight subframes for reproducing each color by gradation display. In other words, each frame is replaced with a set of eight subframes. The subframes are given luminance weights so that the number of display discharge in each subframe is determined. The luminance of each color (red, green or blue) can be set in multiple steps by combining on and off of each subframe. Though the subframes are arranged in the weight order in FIG. 4, they can be arranged in another order. In accordance with this frame structure, the frame period Tf is divided into eight subframe periods Tsf1–Tsf8. In addition, each of the subframe periods Tsf1–Tsf8 is divided into a preparation period TR for equalizing charge distribution in the entire screen, an address period TA for forming charge distribution corresponding to contents of display, and a display period TS for sustaining the lighted state to ensure a luminance level corresponding to a gradation level. The lengths of the preparation period TR and the address period TA are constant regardless of the luminance weight, while the display period TS becomes longer as the luminance weight becomes larger.

Figure 5:
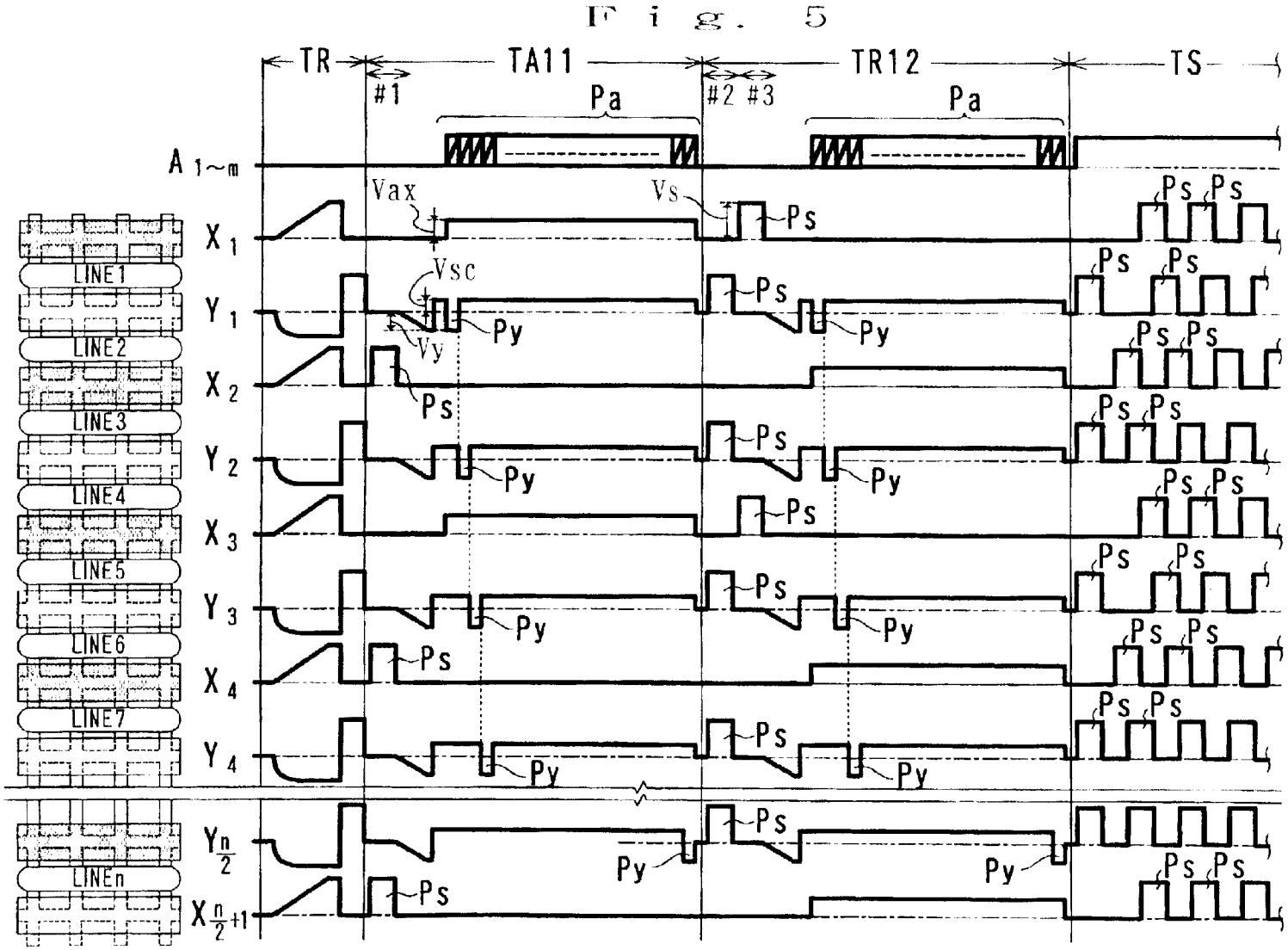
FIG. 5 is a diagram showing voltage waveforms in an example of driving sequence that realizes a progressive display.
Figure 6:
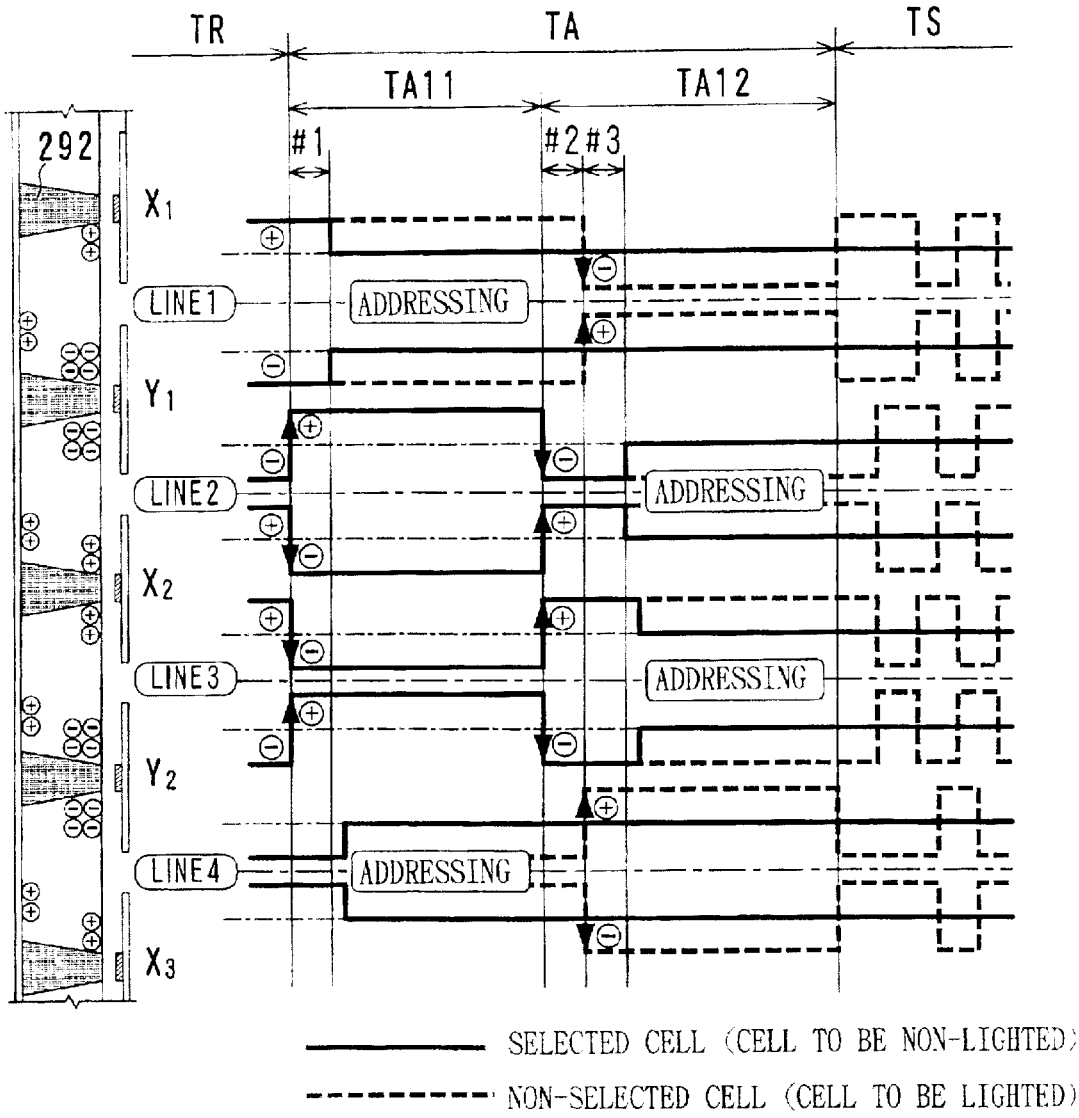
FIG. 6 is a diagram showing polarity changes of wall charge.
Figure 7:
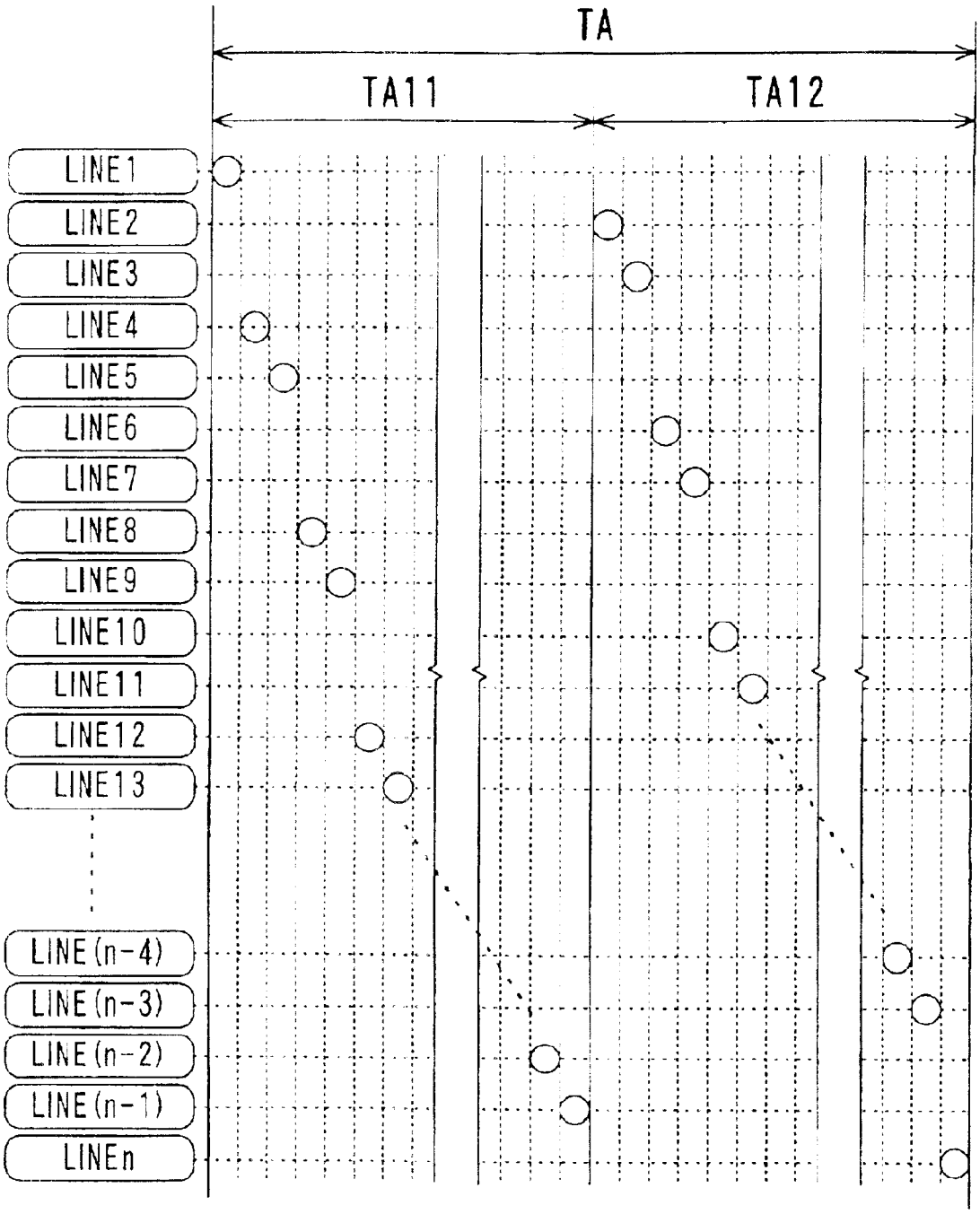
FIG. 7 is a diagram showing an address order.

FIG. 5 is a diagram of voltage waveforms showing an example of a driving sequence realizing the progressive display. FIG. 6 is a diagram showing polarity changes of wall charge. FIG. 7 is a diagram showing an address order. The order of the preparation period TR, the address period TA and the display period TS is common to eight subfields, and the driving sequence is repeated every subfield. The amplitude, the polarity or the timing of the waveforms can be modified variously. Instead of an erasing address format shown in FIGS. 5–7, a writing address format can be adopted.

In the preparation period TR, a ramp waveform pulse, an obtuse waveform pulse and a rectangular waveform pulse are combined appropriately to be applied, so that wall charge sufficient for generating a discharge when the sustaining voltage is applied is formed in each row. An application of a pulse means biasing an electrode temporarily to a predetermined potential. At the end of the preparation period TR, the polarity of wall charge is positive (+) at the display electrode X side in each row and negative (−) at the display electrode Y side. Regarding charge in the vicinity of each of the display electrodes X and Y, substantially the same quantity of wall charge having the same polarity exists at both sides of the horizontal wall 292 as shown in FIG. 6.

As shown in FIG. 5, the display electrode Y is controlled independently as a scan electrode for addressing. The display electrodes X are classified into a first group ($X_1$, $X_3$, $X_5$, . . . ) and a second group ($X_2$, $X_4$, $X_6$ . . . ) in accordance with whether the arrangement order is odd or even noting only the display electrodes X, and a common potential control is performed for each group. In a first half TA11 of the address period TA, a sustaining pulse Ps having an amplitude Vs and the positive polarity is applied to the second group of display electrodes $X_2$, $X_4$, $X_6$ . . . first (#1). Thus, a discharge is generated and the polarity of the wall charge is reversed in the row to which the display electrodes $X_2$, $X_4$, $X_6$ . . . relate (i.e., a target of addressing in a second half TA12). The discharge is localized for each row by the horizontal wall 292. Therefore, concerning the charge in the vicinity of the each display electrode Y, the polarity of the display electrodes $X_2$, $X_4$, $X_6$ . . . side is reversed with respect to the horizontal wall 292, while the polarity of the first group of display electrodes $X_1$, $X_3$, $X_5$ . . . is not reversed. This wall charge control is followed by once altering the potentials of all the display electrodes Y to a selecting potential (Vy) having the negative polarity and then by biasing the same to the non-selecting potential (Vsc), and the first group of display electrodes $X_1$, $X_3$, $X_5$ . . . are biased to the selecting potential (Vax). In that state, a scan pulse Py is applied to all the display electrodes Y one by one. Namely, the display electrode Y of the selected row is temporarily biased to the selecting potential (Vy). When the scan pulse Py is applied to the display electrodes Y in the arrangement order, the row selection is performed in such a way that two rows are selected at intervals of two rows after selecting the first row as shown in FIG. 7. In synchronization with the row selection by the scan pulse Py, an address pulse Pa is applied to the address electrode A corresponding to the cell to be non-lighted in the following display period TS (i.e., the cell to be selected in the erase addressing). The address discharge occurs in a cell where the display electrode X is biased, the scan pulse Py is applied and the address pulse Pa is applied, so that the wall charge is erased as shown with the solid line in FIG. 6. The address pulse Pa is not allied to a cell to be lighted (non-selected cell), and the wall charge remains in the cell as shown with the broken line in FIG. 6.

It is important that despite of the each display electrode Y common to the neighboring two rows, the addressing is performed only for one of the two rows. As explained above, prior to the row selection, the polarity of the wall charge in the rows to which the second group of display electrodes $X_2$, $X_4$, $X_6$ . . . relate is reversed, so that the wall charge works to cancel the scan pulse Py and the address discharge does not occur in the rows.

In the second half TA12 of the address period TA, the sustaining pulse Ps is applied to every display electrode Y first, and then the polarity of the wall charge in the rows to which the display electrodes $X_2$, $X_4$, $X_6$ . . . relate is reversed again (#2). Namely, the charged state of the target to be addressed in the second half TA12 is reset to the state at the end of the preparation period TR. After that, the sustaining pulse Ps is applied to the first group of display electrodes $X_1$, $X_3$, $X_5$ . . . (#3). Thus, a discharge occurs in the non-selected cell in the row that was selected in the first half TA11, so that the polarity of the remaining wall charge is reversed. After this wall charge control, the potential of all the display electrodes Y is once altered to the selecting potential (Vy) gradually, and the display electrodes Y are biased to the non-selecting potential (Vsc). The display electrodes $X_2$, $X_4$, $X_6$ . . . are biased to the selecting potential (Vax). In this state, the scan pulse Py is applied to all the display electrodes Y one by one. When the scan pulse Py is applied to the display electrodes Y in the arrangement order, the rows that were not selected in the first half TA11 are selected in series as shown in FIG. 7. In synchronization with the row selection by the scan pulse Py, the address pulse Pa is applied to the address electrode A corresponding to the selected cell so as to generate the address discharge. Since the polarity of the wall charge is reversed in advance for non-target rows in the same way as in the first half TA11, the wall charge works to cancel the scan pulse Py. Accordingly, the address discharge does not occur in the non-target rows.

A practical example of the bias potential is as follows. Vs is 160–190 volts. Vy is −40 to −90 volts. Vsc is 0–60 volts. Vax is 0–80 volts.

In the display period TS, the sustaining pulse Ps is simultaneously applied to all the display electrodes Y first. Thus, a display discharge is generated in the rows to which the display electrode Y and the display electrodes $X_1$, $X_3$, $X_5$ . . . relate, so that the relationship between the polarity of the wall charge and the display electrodes X and Y becomes the same in all cells to be lighted. After that, the sustaining pulse Ps is applied to the display electrode X and the display electrode Y at the after-mentioned timing in accordance with the present invention. When the pulse is applied, a display discharge occurs in the cell to be lighted and to which the sustaining voltage is applied.

Hereinafter, the sustaining control according to the present invention will be explained.

Figure 8:
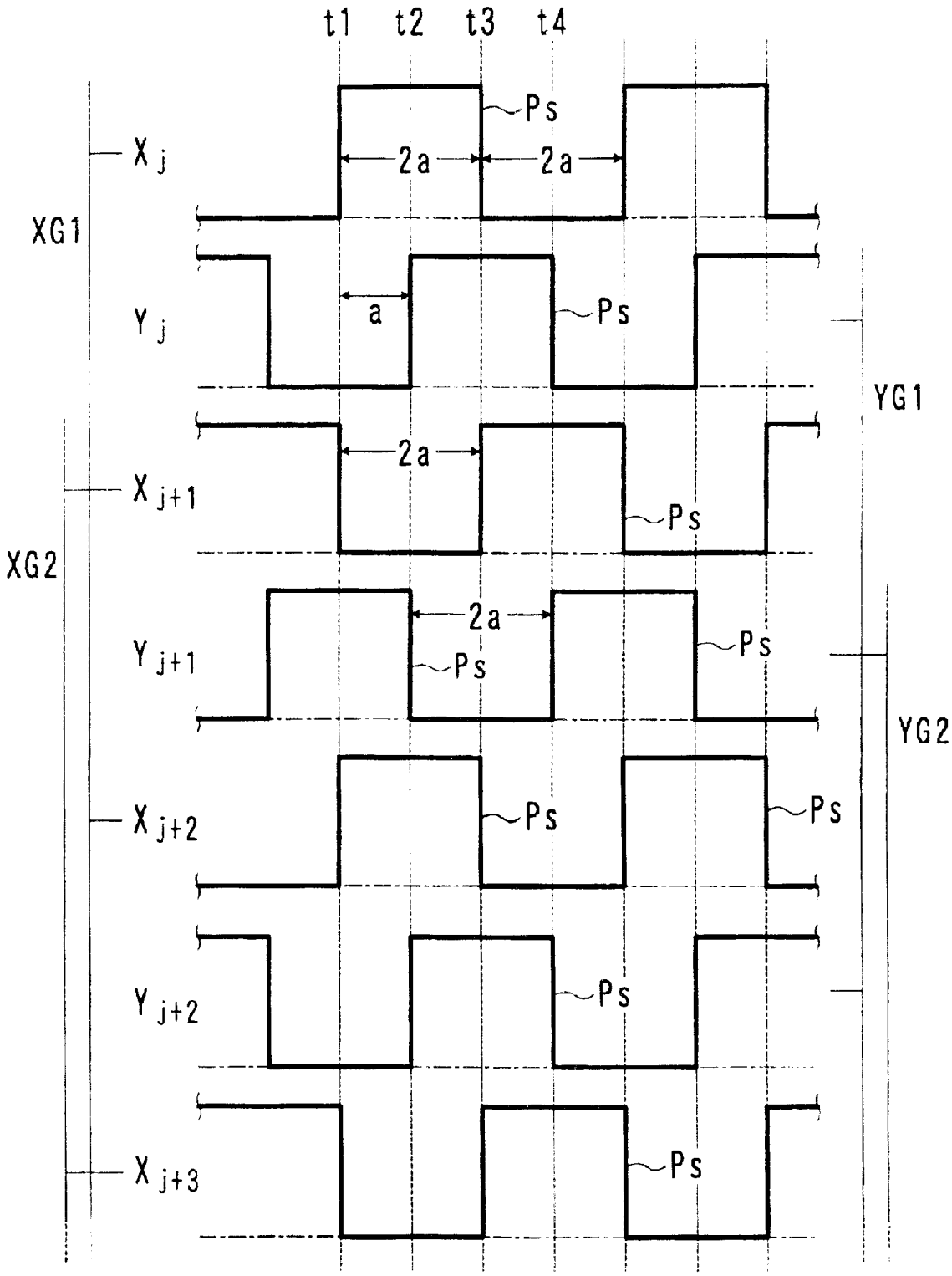
FIG. 8 is a diagram showing a first example of driving waveforms in a display period.
Figure 9:
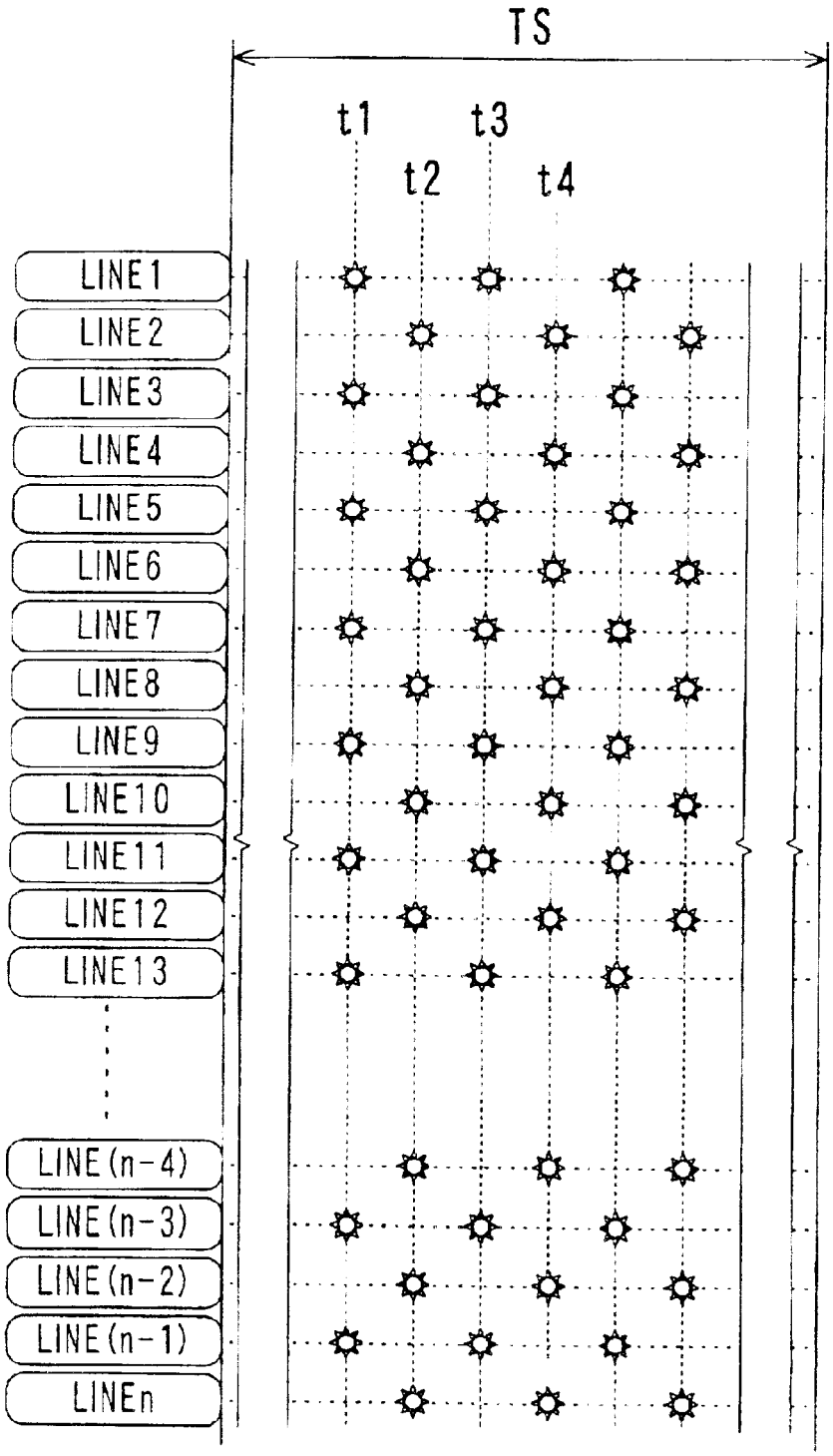
FIG. 9 is a diagram showing relationship between a row and discharge timing in the case where the driving waveforms of the first example is applied.

FIG. 8 is a diagram showing a first example of driving waveforms in a display period. FIG. 9 is a diagram showing relationship between a row and a discharge timing in the case where the driving waveforms of the first example are applied. When the sustaining is performed, the display electrodes X are classified into a first group XG1 and a second group XG2 in accordance with whether the arrangement order is odd or even noting only the display electrodes X in the same way as in the addressing, and a common potential control is performed for each group. In addition, the display electrodes Y are also classified into a first group YG1 and a second group YG2 in accordance with whether the arrangement order is odd or even noting only the display electrodes Y, and a common potential control is performed for each group. In the first example, the number of groups k is 2 for each of the display electrodes X and Y.

A rectangular voltage pulse train including plural sustaining pulses Ps in a constant period (=4a) is applied to the display electrodes X of each group in series with being delayed by the time of the pulse width (=2a) multiplied by 2/k. Since k=2 in this example, the delay time is the same as the pulse width. Then, a similar rectangular voltage pulse train is applied to the display electrodes Y in such a way that the delay time between the neighboring display electrodes X becomes the pulse width multiplied by 1/k (=2a/2=a). Thus, the display discharge occurs alternately in the odd row and the even row.

For example, at a leading edge point t1 of the sustaining pulse Ps for the group XG1, a predetermined potential difference is generated between the display electrode X of the group XG1 and the display electrode Y of the group YG1, as well as between the display electrode X of the group XG2 and the display electrode Y of the group YG2. Therefore, a display discharge is generated in the odd row. Since there is a certain delay of discharge in reality, a length of delay a is set to a value of 500 nanoseconds or more.

At a leading edge point t2 of the sustaining pulse Ps for the group YG1, a predetermined potential difference is generated between the display electrode Y of the group YG1 and the display electrode X of the group XG2, as well as between the display electrode Y of the group YG2 and the display electrode X of the group XG1. Therefore, a display discharge is generated in the even row.

At a trailing edge point t3 of the sustaining pulse Ps for the group XG1, a potential difference having the polarity opposite to the previous one is generated between the display electrode X of the group XG1 and the display electrode Y of the group YG1, as well as between the display electrode X of the group XG2 and the display electrode Y of the group YG2. Therefore, a display discharge is generated again in the odd row.

At a trailing edge point t4 of the sustaining pulse Ps for the group YG1, a potential difference having the polarity opposite to the previous one is generated between the display electrode Y of the group YG1 and the display electrode X of the group XG2, as well as between the display electrode Y of the group YG2 and the display electrode X of the group XG1. Therefore, a display discharge is generated again in the even row.

Since the duty ratio of the illustrated rectangular voltage pulse train is 50%, the display discharge can be generated in a constant interval (=a). Namely, the optimal duty ratio is 50% for enhancing reliability of driving by equalizing a allowable time to the discharge delay. However, the duty ratio is not limited to 50%. Any other value can be used for the progressive display.

When the light timing of cells in an odd row differs from that in an even row, the peak value of discharge current is reduced by half from that in the simultaneous lighting, so that the load of the driving circuit decreases. Even if the light timing differs, a bright display can be obtained in the same way as in the simultaneous lighting.

By applying the pulse in this way, an electromagnetic interference (EMI) can be reduced. Noting the waveform of the display electrode X in FIG. 8, potential variations in the group XG1 and the group XG2 have the complementary relationship. When the potential in one of the groups rises, the other drops, and vice versa. Regarding the pulse train as an alternating signal, the group XG1 and the group XG2 have the opposite phases to each other. If the number of rows n is even, the number of electrode in the group XG1 is larger than that in the group XG2 by one. However, since the number of rows n is usually more than hundreds, the number of electrodes in the group XG1 can be regarded as substantially equal to that in the group XG2. Namely, almost every display electrode X has another display electrode X to make a pair whose potential variation has the complementary relationship. Hereinafter, this pair is called "complementary display electrode pair". Similarly, almost every display electrode Y has another display electrode Y to make a complementary display electrode pair.

Figure 10:
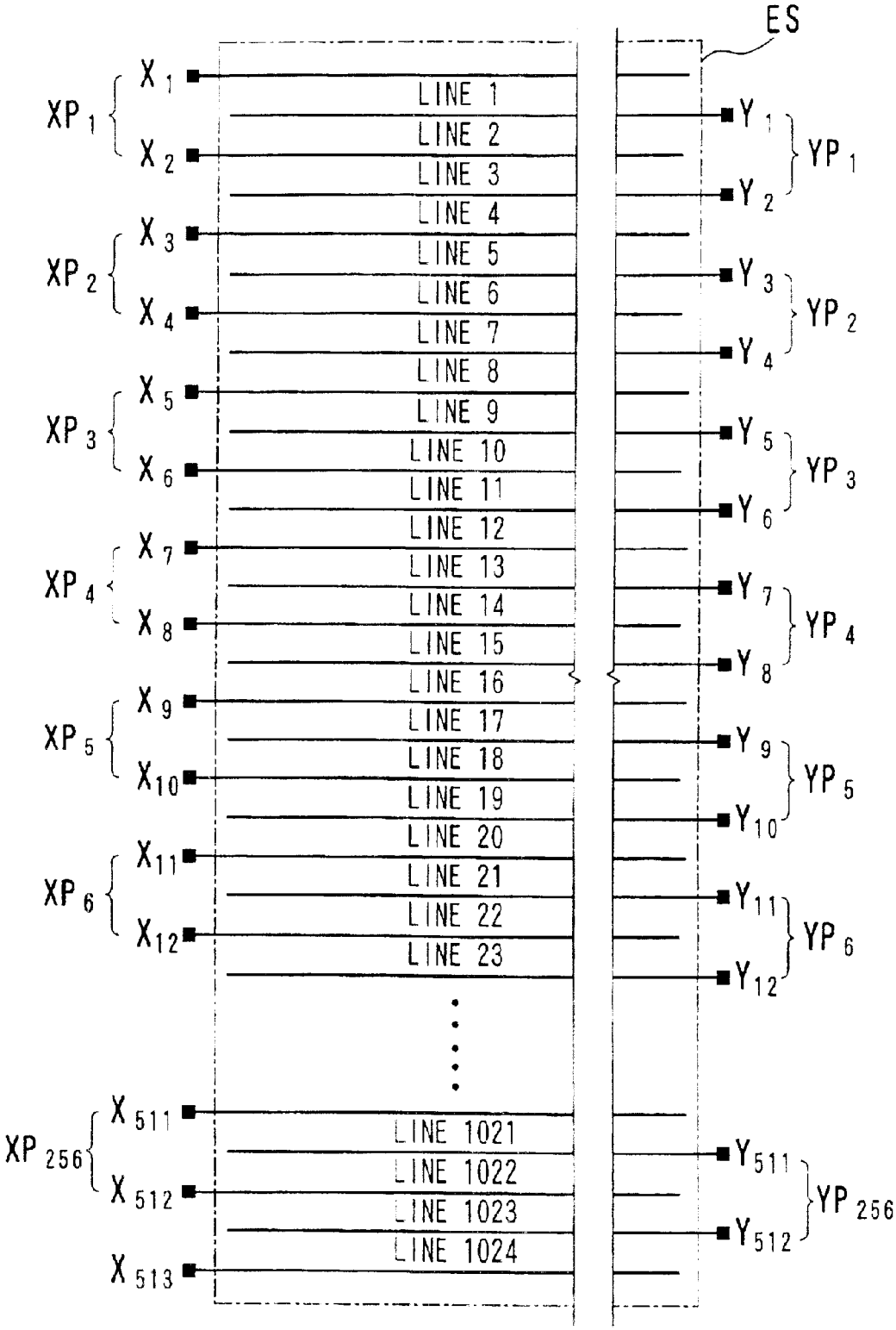
FIG. 10 is a diagram showing a first example of setting of complementary display electrode pairs.

FIG. 10 is a diagram showing a first example of setting of complementary display electrode pairs. In FIG. 10, the number of rows n is 1024. In the illustrated example, the total 256 of complementary display electrode pairs $XP_1$–$XP_{256}$ are set by dividing the display electrode X by two in the arrangement order. In the same way, the total 256 of complementary display electrode pairs $YP_1$–$YP_{256}$ are set by dividing the display electrode Y.

Figure 11:
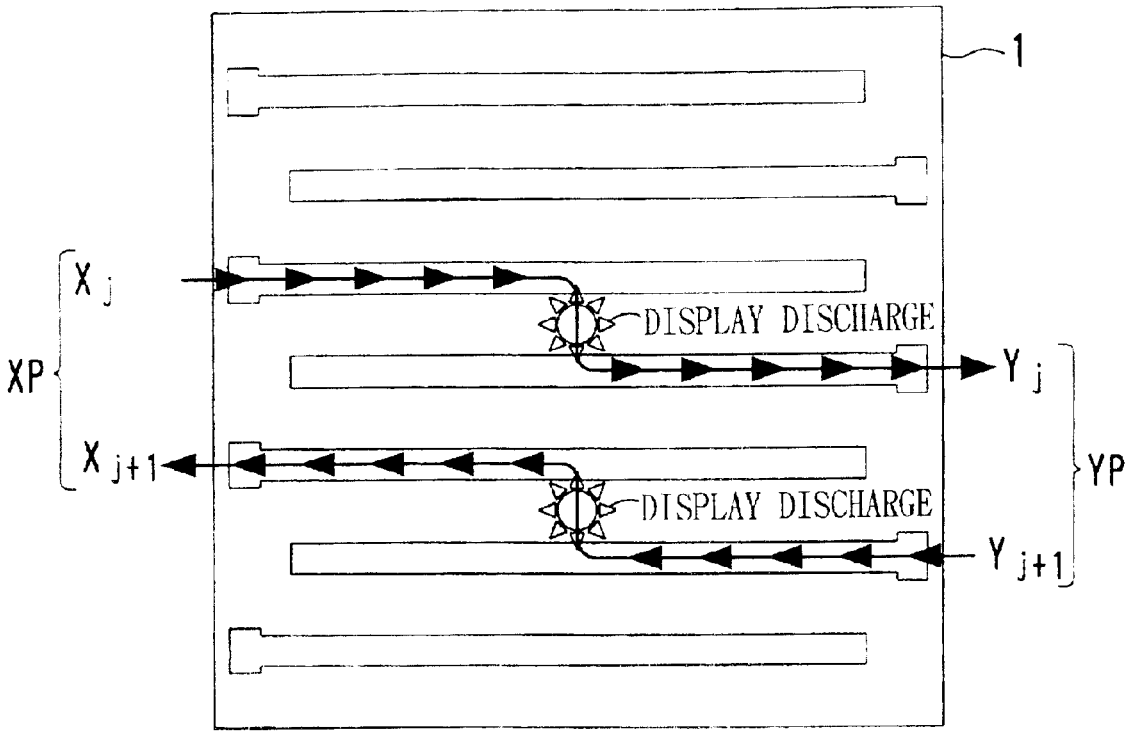
FIG. 11 is a diagram showing directions of discharge current flowing through display electrodes in the first embodiment.

FIG. 11 is a diagram showing directions of discharge current flowing through display electrodes in the first embodiment. When a display discharge occurs in an odd row (or in an even row), the direction of current flowing in the display electrode $X_j$ in the row direction of the complementary display electrode pair XP is opposite to that in the display electrode $X_{j+1}$. Therefore, magnetic fields generated by the display electrode $X_j$ and by the display electrode $X_{j+1}$ are canceled by each other. In general, a pattern of light and non-light is similar between neighboring rows. In this case, the magnetic fields can be cancelled almost completely. Similarly, the directions of currents flowing in the display electrode $Y_j$ and the display electrode $Y_{j+1}$ of the complementary display electrode pair YP are opposite to each other, so magnetic fields generated by the display electrode $Y_j$ and by the display electrode $Y_{j+1}$ are canceled by each other.

Figure 12:
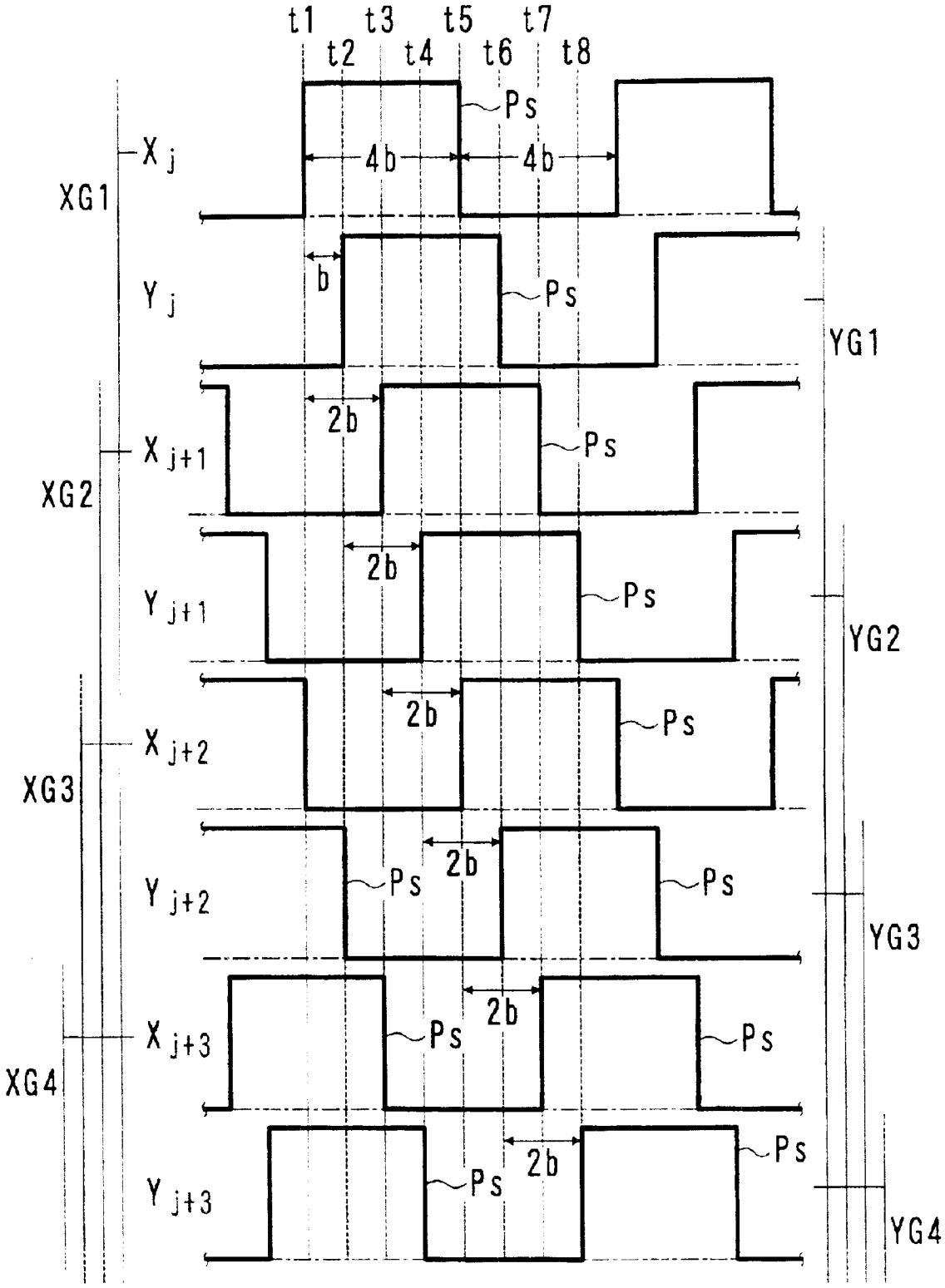
FIG. 12 is a diagram showing a second example of the driving waveforms in the display period.
Figure 13:
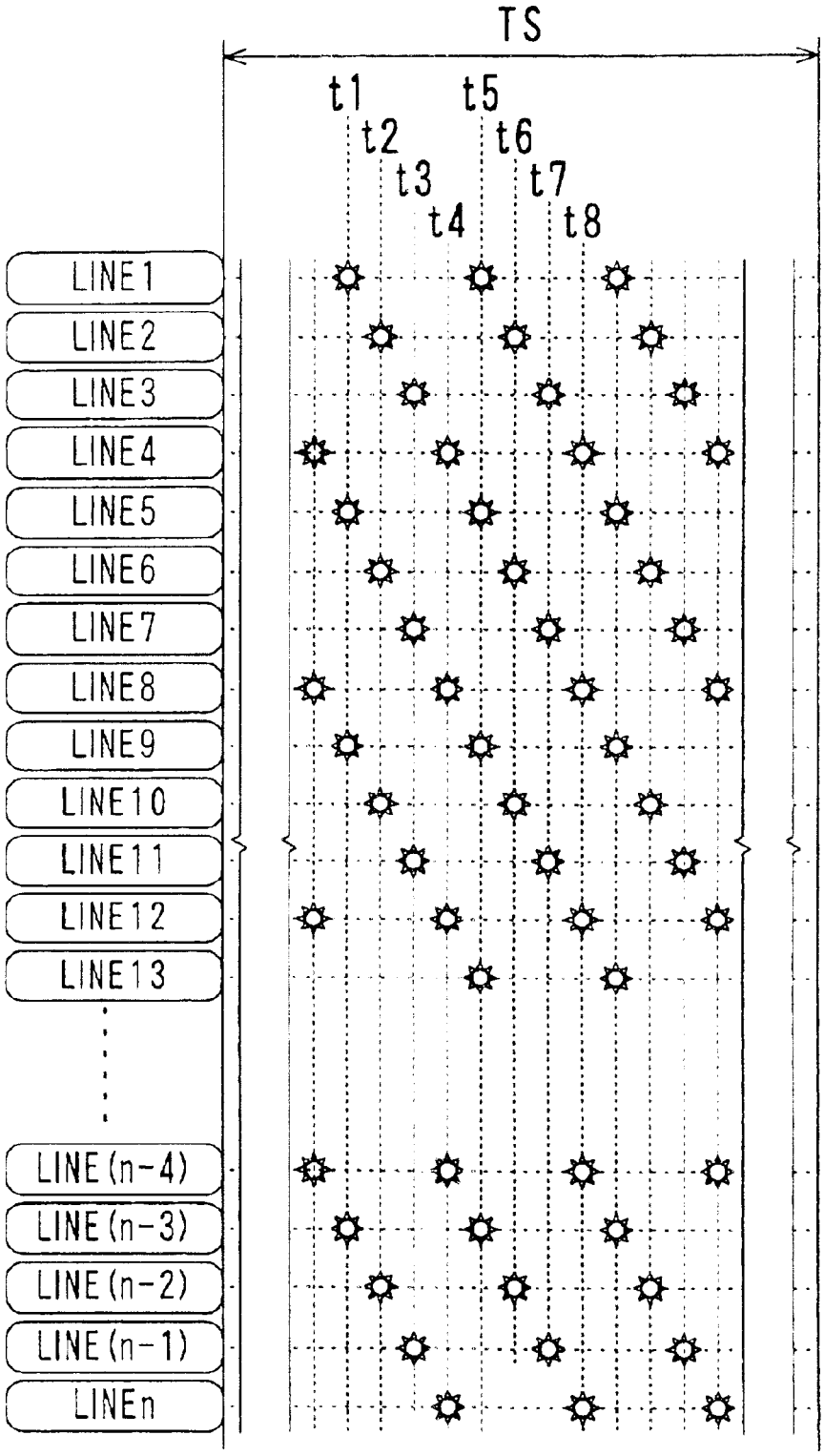
FIG. 13 is a diagram showing relationship between a row and discharge timing in the case where the driving waveforms of the second example is applied.
Figure 14:
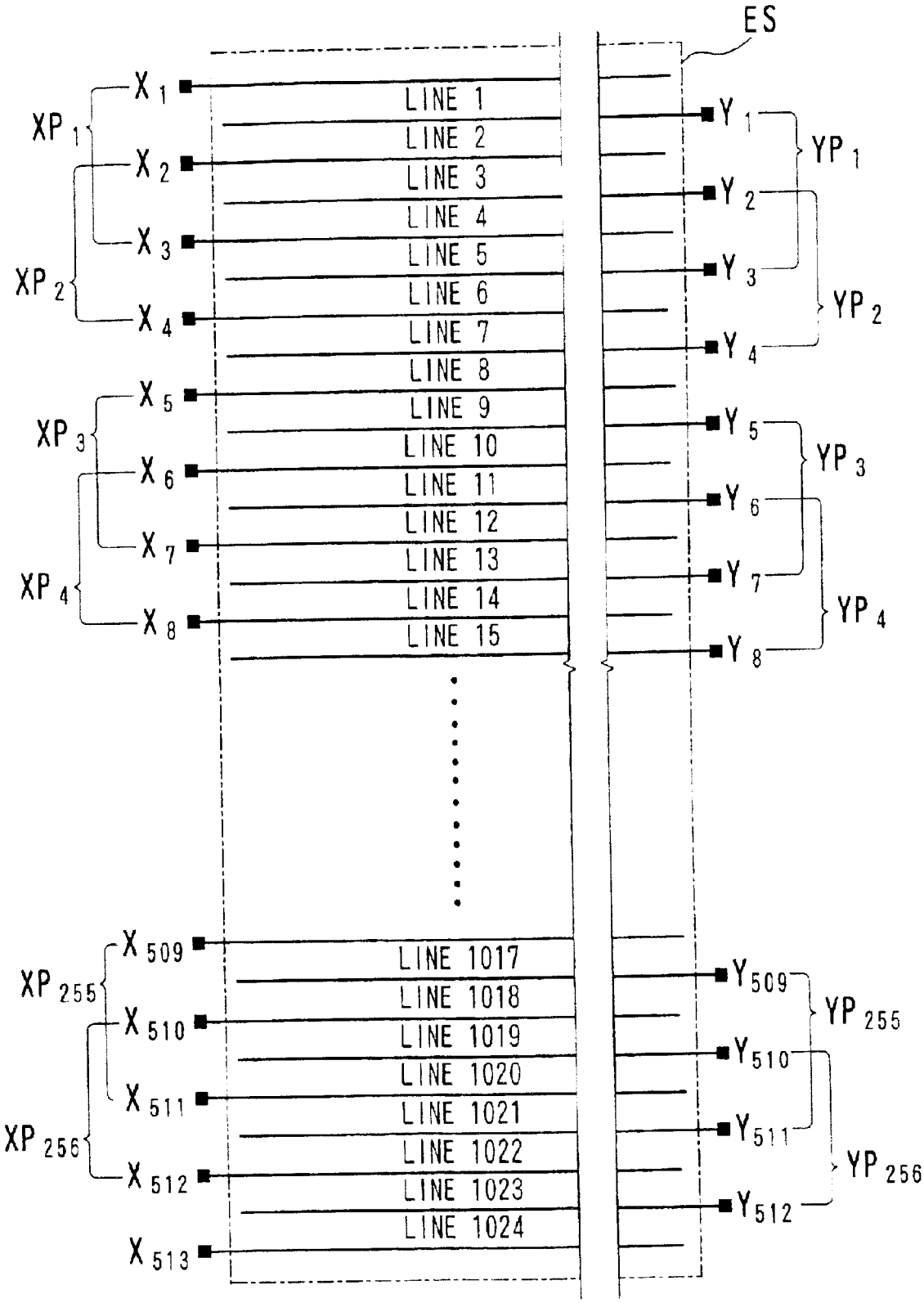
FIG. 14 is a diagram showing a second example of setting of complementary display electrode pairs.

FIG. 12 is a diagram showing a second example of the driving waveforms in the display period. FIG. 13 is a diagram showing relationship between a row and a discharge timing in the case where the driving waveforms of the second example are applied. FIG. 14 is a diagram showing a second example of setting of complementary display electrode pairs.

In the example shown in FIG. 12, the display electrodes X are classified into four groups XG1, XG2, XG3 and XG4 by dividing the display electrodes X in the arrangement order one by one for sustaining, and a common potential control is performed for each group. In the same way, the display electrodes Y are classified into four groups YG1, YG2, YG3 and YG4, and a common potential control is performed for each group. In the second example, the number of groups is 4 for each of the display electrodes X and Y.

A rectangular voltage pulse train including plural sustaining pulses Ps in a constant period (=8b) is applied to the display electrodes X in one group to another while shifting the rectangular voltage pulse train by the time of the pulse width (=4b) multiplied by 2/k. The duty ratio of the rectangular voltage pulse train is 50%. Since k=4 in this example, the shift is a half of the pulse width. Then, a rectangular voltage pulse train is applied to the display electrodes Y in such a way that the shift between neighboring display electrodes X becomes the pulse width multiplied by 1/k (=4b/4 =b). Thus, display discharges are generated in the corresponding rows at the rate of one per four rows as shown in FIG. 13. The corresponding rows are replaced with others in the arrangement order. The display discharge occurs in a constant period 4*b* in each row as understood from points t1–t8 in FIG. 13.

In this example too, display electrodes X and Y constitute a complementary display electrode pair for reducing an electromagnetic interference. As shown in FIG. 14, odd-numbered display electrodes X are divided by two in the arrangement order, and even-numbered display electrodes X are divided by two in the arrangement order, so that the total 256 of complementary display electrode pairs $XP_1$–$XP_{256}$ are set. In the same way, the total 256 of complementary display electrode pairs $YP_1$–$YP_{256}$ are set by dividing the display electrodes Y.

Figure 15:
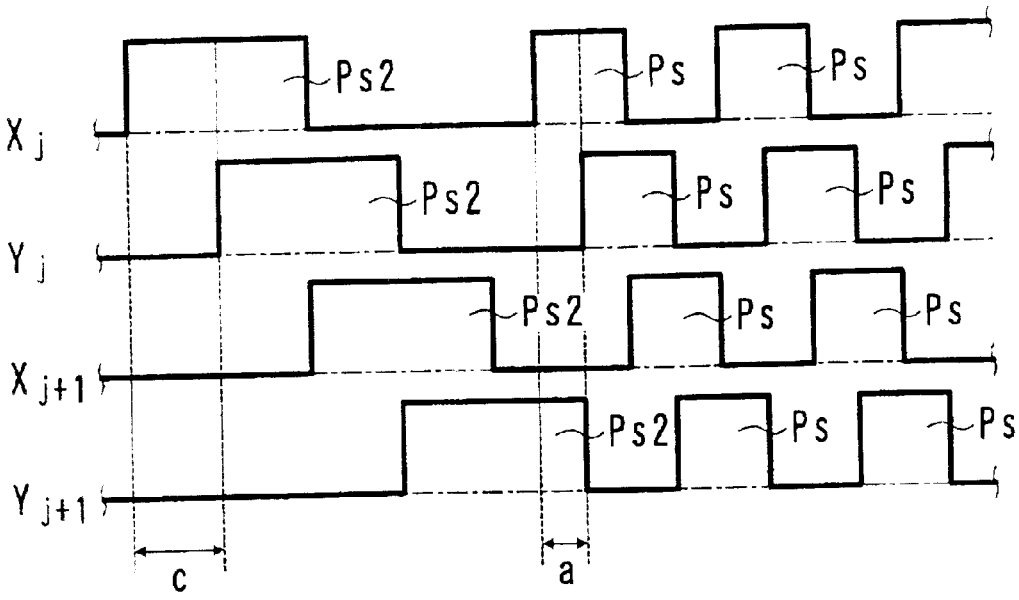
FIG. 15 is a diagram showing a third example of the driving waveforms in the display period.

In the above-mentioned first and second examples of the driving waveforms concerning the sustaining, the display discharge can be generated securely by enlarging the initial pulse width in the display period, so that the subsequent sustaining can be stabilized. FIG. 15 shows waveforms of sustaining pulse Ps2 having a large pulse width that is applied by shifting by the period c each before applying the sustaining pulse Ps. Also when the sustaining pulse Ps2 is applied for the display discharge, the magnetic fields are cancelled by each other in the complementary display electrode pair.

Figure 16:
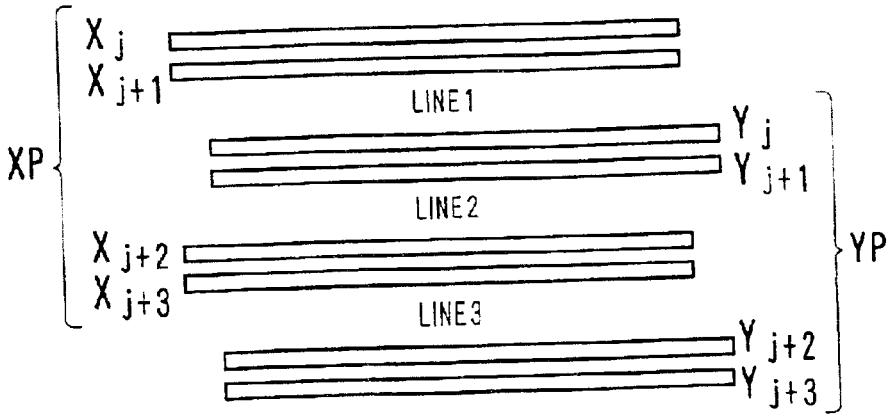
FIG. 16 is a diagram showing a first variation of the display electrode structure and an example of setting of complementary display electrode pairs.
Figure 17:
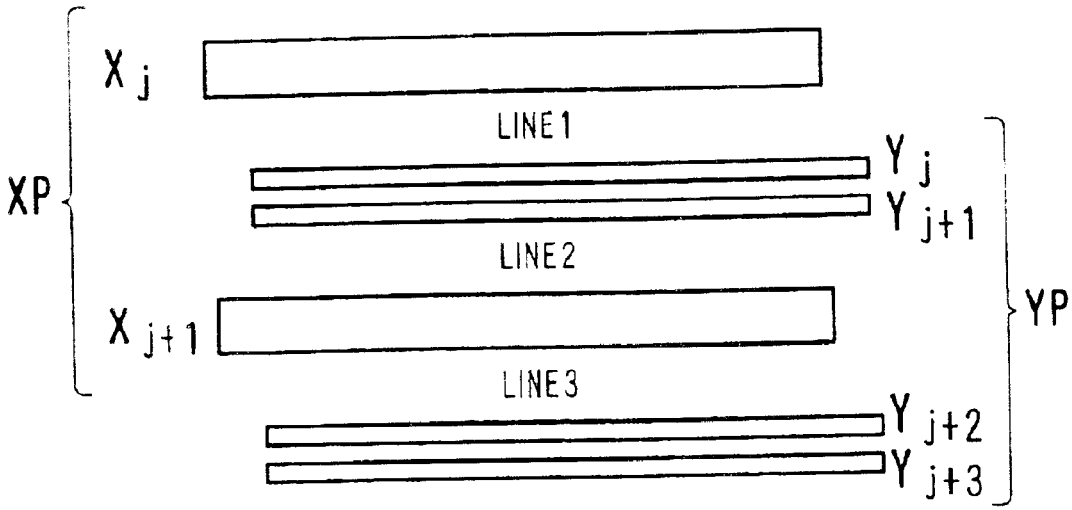
FIG. 17 is a diagram showing a second variation of the display electrode structure and an example of setting of complementary display electrode pairs.

The application of the above-mentioned driving method is not limited to the electrode structure in which each of display electrodes X and Y is shared for two rows of display. Also in the case where plural display electrodes corresponding to two rows are arranged as shown in FIG. 16 or 17, the effect similar to the sharing case can be obtained if the potential of the plural display electrode are the same. In the example shown in FIG. 16, two of the display electrodes X and Y are arranged between rows. This corresponds to the structure in which the display electrodes X and Y shown in FIG. 3 are separated in the column direction at the boundary of the horizontal wall 292. However, at both sides of the display electrode arrangement, two electrodes are not required to be arranged on one side, but one display electrode is arranged on one side. In the example shown in FIG. 16 too, complementary pairs are set for the display electrodes X and for the display electrodes Y so that the electromagnetic interference is reduced. In this case, the complementary pairs are set to include a unit and another unit of two electrodes between neighboring rows, instead of combining each of the display electrodes X and Y. At both sides of the display electrode arrangement, the unit includes only one display electrode. In this way, complementary display electrode unit pairs XP and YP are set corresponding to the above-mentioned complementary display electrode pair, so that the object of the present invention can be achieved by applying the driving waveforms shown in FIGS. 8 and 12 as they are. The applied voltage can be set independently for each row in the example shown in FIG. 16, so that flexibility of driving waveforms for initialization or addressing can be enhanced. In the example shown in FIG. 17, two of the display electrodes Y are arranged between rows, and every display electrode X except ends is shared by two rows of display. This corresponds to the structure in which the display electrodes Y shown in FIG. 3 are separated in the column direction at the boundary of the horizontal wall 292. In the example shown in FIG. 17, each display electrode X is used as a unit, and two display electrodes Y between neighboring rows are used as a unit, so as to set a complementary pair of the units. In this way, complementary display electrode unit pairs XP and YP are set, so that the object of the present invention can be achieved by applying the driving waveforms shown in FIGS. 8 and 12 as they are. The example shown in FIG. 17 is suitable for controlling independently for each row only for the display electrode Y.

[Second Embodiment]

[Device Structure]

Figure 18:
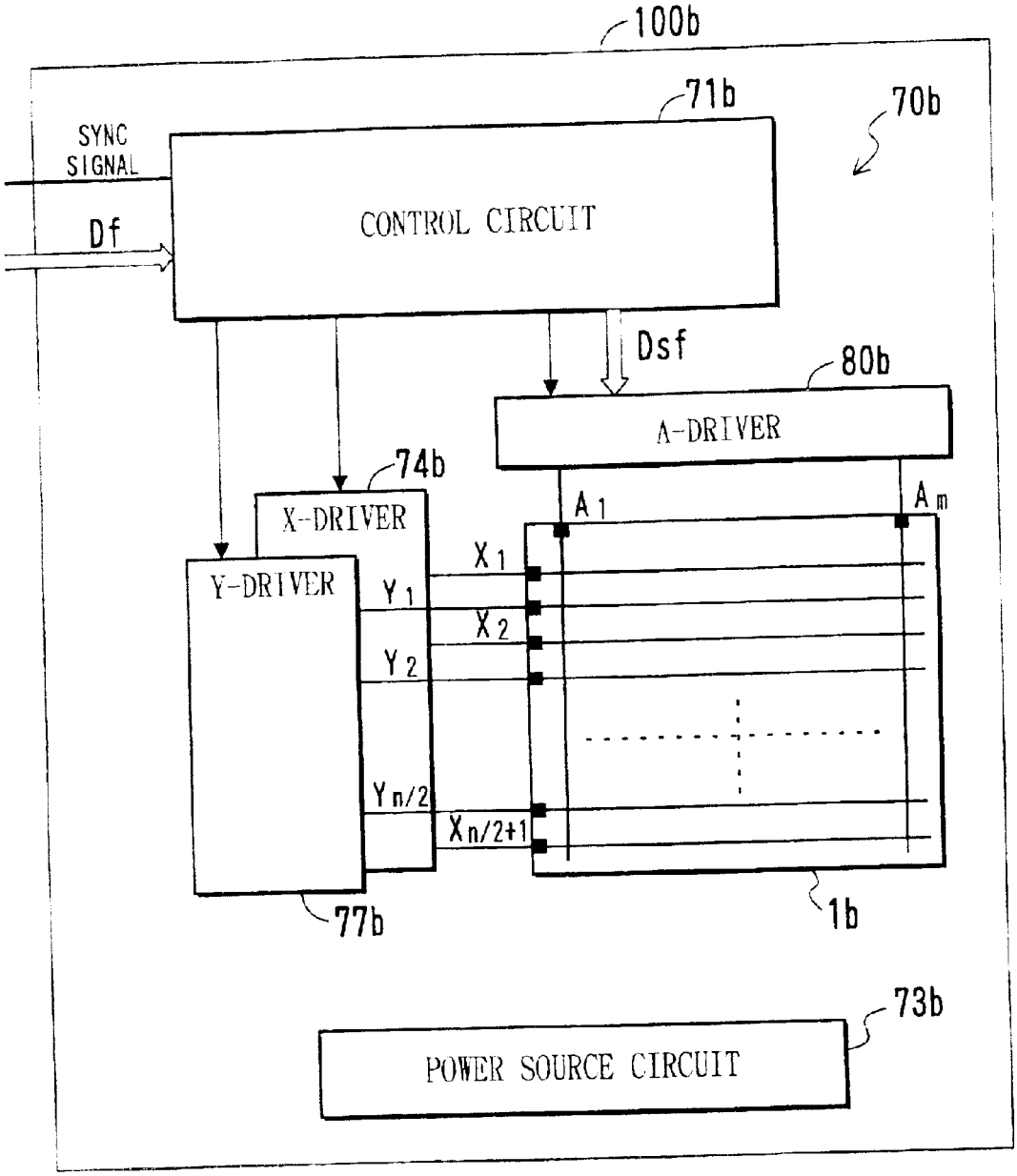
FIG. 18 is a block diagram of a display device according to a second embodiment of the present invention.

FIG. 18 is a block diagram of a display device according to a second embodiment of the present invention. The display device 100*b* comprises a surface discharge type PDP 1*b* and a drive unit 70*b* and has a display function similar to the display device 1 of the above-mentioned first embodiment. The PDP 1*b* has the total (n+1) of display electrodes X and Y arranged in parallel at a constant pitch in the order of X, Y, X, . . . , Y, X and m address electrodes A. The character "n" is the number of rows of a matrix display while "m" is the number of columns. The drive unit 70*b* includes a control circuit 71*b*, a power source circuit 73*b*, a X driver 74*b*, a Y-driver 77*b*, and an A-driver 80*b*. The drive unit 70*b* is supplied with frame data Df together with synchronizing signals from external equipment. The frame data Df are converted into subfield data Dsf in the control circuit 71*b*.

The display device 100*b* has a feature that terminals of the display electrodes X and Y are arranged in one side of the display screen in the row direction of the PDP 1*b*. All the display electrodes X and Y are supplied with electricity from one side of the display screen. Thus, the driving waveform for reducing the electromagnetic interference can be simplified in the progressive display of the PDP 1*b* of Form B in which the display electrodes X and Y are arranged at a constant pitch. The structure inside the display screen of the PDP 1*b* is the same as the structure explained with reference to FIG. 2.

Figure 19:
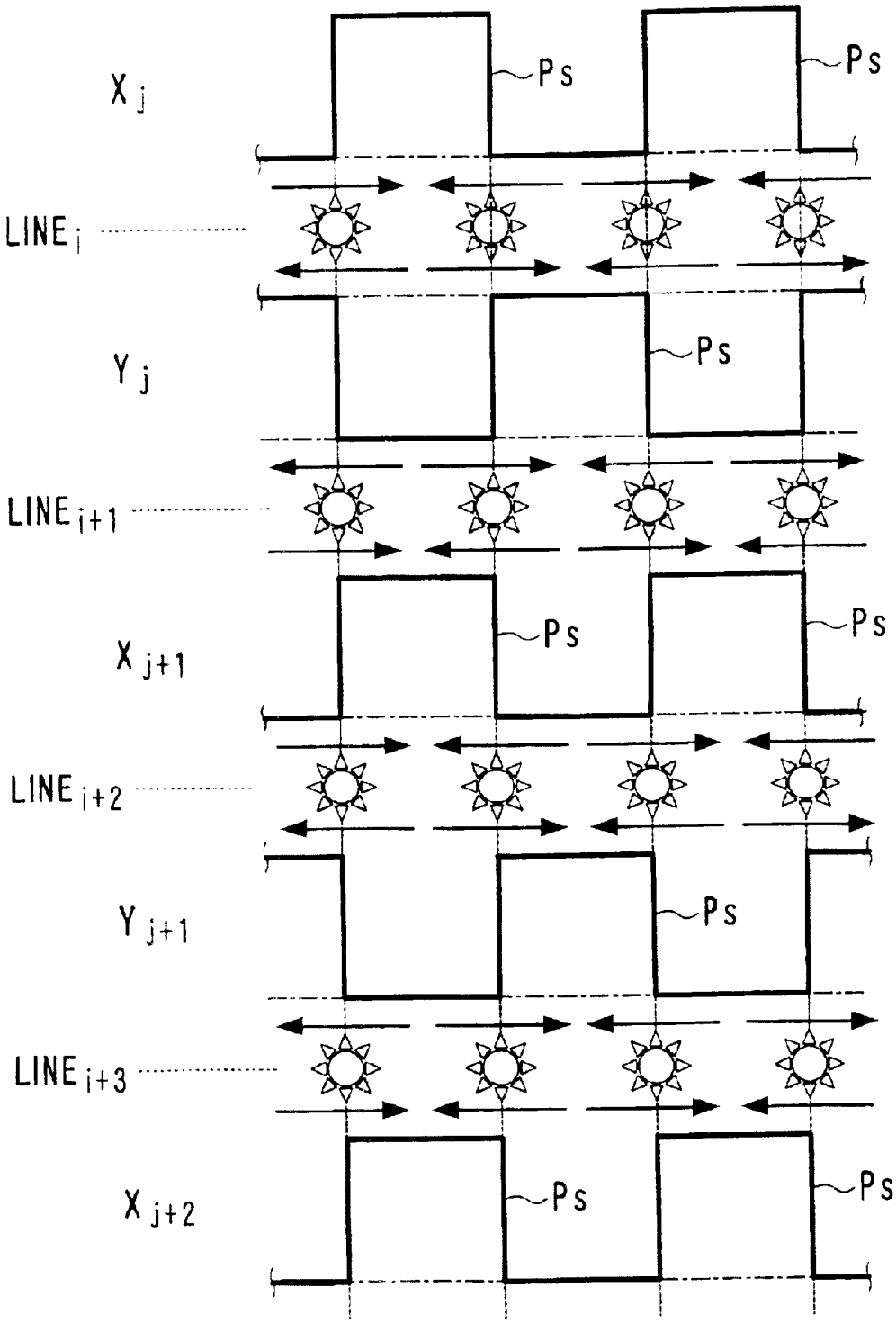
FIG. 19 is a diagram for explaining a sustaining operation in the second embodiment.
Figure 20:
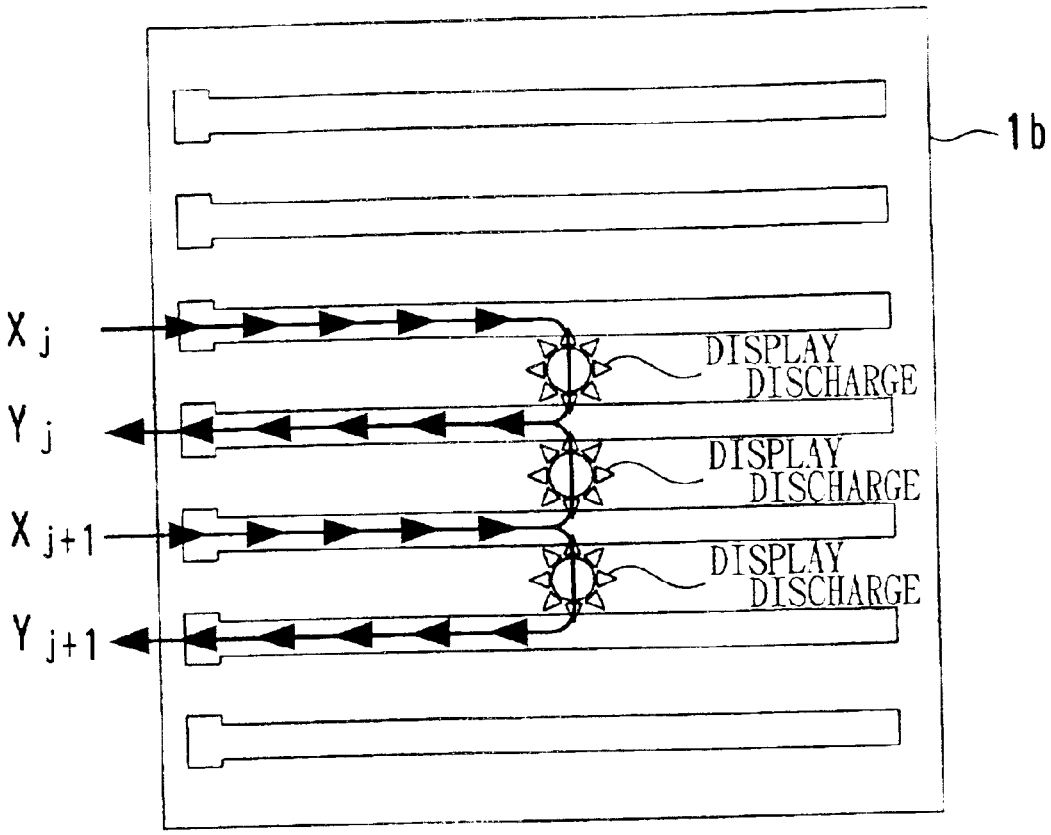
FIG. 20 is a diagram showing directions of discharge current flowing through display electrodes in the second embodiment.

FIG. 19 is a diagram for explaining a sustaining operation in the second embodiment. FIG. 20 is a diagram showing directions of discharge current flowing through display electrodes in the second embodiment. In the display period for sustaining, the sustaining pulse Ps is applied to all the display electrodes X and all the display electrodes Y alternately. Every application of the sustaining pulse Ps generates a display discharge both in an odd row and in an even row. As shown with arrows in FIGS. 19 and 20, the directions of current flowing in the display electrodes X and Y forming a surface discharge gap are opposite to each other in the row direction of each row. Therefore, the magnetic fields generated in the display electrodes X and Y are cancelled by each other. Therefore, the magnetic fields disappear completely in theory.

In the above-mentioned examples, the progressive display is performed in which contents of display are set for each row. However, the present invention can be applied to another case in which one row of display data are used for neighboring two rows.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A driving method of an AC type plasma display panel including a display screen in which first display electrodes and second display electrodes arranged in spaced relationship so as to form plural surface discharge gaps corresponding to plural rows of a matrix display, and a relative position relationship of first and second display electrodes defining neighboring rows, in a row arrangement direction, is opposite and respective terminals, connected to the first and the second display electrodes to supply electricity thereto, are located at respective, opposite sides of the display screen, the method comprising:

dividing the first display electrodes into plural pairs of first complementary display electrodes, each of the first complementary display electrodes being made up of one first display electrode adjacent only to one second display electrode;

dividing the second display electrodes into plural pairs of second complementary display electrodes, each of the second complementary display electrodes being made up of one second display electrode adjacent only to one first display electrode; and generating display discharges by changing potentials of the first and the second display electrodes so that a potential change has a complementary relationship between one first complementary display electrode and the other first complementary display electrode of a selected pair of complementary first display electrodes, for each of the first complementary display electrode pairs in succession, as well as between one second complementary display electrode and the other second complementary display electrode of a selected pair of complementary second display electrodes, in alternate succession with the first complementary display electrode pairs, for each of the second complementary electrode pairs and so that a sustaining voltage is applied to the surface discharge gap at the ratio of one row per k ($k \geqq 2$) rows and the surface discharge gaps to which the sustaining voltage is applied are changed sequentially.

2. A driving method of an AC type plasma display panel in which first display electrodes and second display electrodes are arranged so as to form surface discharge gaps for rows of a matrix display, and the position relationship between the first and the second display electrodes forming a surface discharge gap in the row arrangement direction is opposite between neighboring two rows, and terminals for supplying electricity to the first and the second display electrodes are divided into both sides of a display screen, the method comprising the steps of:

dividing the first display electrodes into k ($k \geqq 2$) groups by making a unit of each of electrode arrays including the first display electrode neighboring only the second display electrode and the plural first display electrodes arranged without including a surface discharge gap and by dividing the first display electrodes in the arrangement order by one unit; and generating a display discharge by applying a rectangular voltage pulse train having a constant period to the first display electrodes sequentially by one group while shifting the rectangular voltage pulse train by the time corresponding to a pulse width multiplied by 2/k, and by applying another rectangular voltage pulse train similar to the rectangular voltage pulse train to the second display electrodes so that the shift between neighboring first display electrodes becomes the time corresponding to a pulse width multiplied by 1/k.

3. A driving method of an AC type plasma display panel having a display screen in which first display electrodes and second display electrodes are arranged in spaced relationship so as to form plural surface discharge gaps defining corresponding, plural rows of a matrix display and so that two neighboring rows share one electrode for display, and respective terminals, connected to the first and the second display electrodes to supply electricity thereto, are located at respective, opposite sides of the display screen, the method comprising:

relating the first display electrodes as plural complementary pairs of display electrodes;

relating the second display electrodes as plural complementary pairs of second display electrodes; and generating display discharges by changing potentials of the first and the second display electrodes so that a potential change and resulting current flow has a complementary relationship between successively selected, first and second display electrodes of each pair of first and second complementary display electrodes, in succession for all first and second display electrodes of the first and second complementary pairs thereof, and so that a sustaining voltage is applied across the display electrodes at the ratio of one row per k (k≧2) rows and the interelectrodes to which the sustaining voltage is applied are changed sequentially.

4. A driving method of an AC type plasma display panel in which first display electrodes and second display electrodes are arranged so as to form surface discharge gaps for rows of a matrix display and so that neighboring two rows share one electrode for display, and terminals for supplying electricity to the first and the second display electrodes are divided into both sides of a display screen, the method comprising the steps of:

dividing the first display electrodes into k (k≧2) groups by dividing the first display electrodes in the arrangement order one by one; and generating a display discharge by applying a rectangular voltage pulse train having a constant period to the first display electrodes sequentially by one group while shifting the rectangular voltage pulse train by the time corresponding to a pulse width multiplied by 2/k, and by applying another rectangular voltage pulse train similar to the rectangular voltage pulse train to the second display electrodes so that the shift between neighboring first display electrodes becomes the time corresponding to a pulse width multiplied by 1/k.

5. The driving method according to claim 4, wherein a duty ratio of the rectangular voltage pulse train is 50%.

6. The driving method according to claim 4, further comprising the step of applying a sustaining voltage pulse having a larger pulse width than that of the rectangular voltage pulse train to the first display electrodes and the second display electrodes prior to the application of the rectangular voltage pulse train.

7. A driving method of an AC type plasma display panel in which first display electrodes and second display electrodes are arranged so as to form surface discharge gaps for rows of a matrix display and so that two first display electrodes and two second display electrodes except both ends of the display electrode arrangement are arranged alternately, and terminals for supplying electricity to the first and the second display electrodes are divided into both sides of a display screen, the method comprising the steps of:

setting plural electrode unit pairs about the first display electrodes by dividing the first display electrodes by a unit of neighboring two first display electrodes;

setting plural electrode unit pairs about the second display electrodes by dividing the second display electrodes in the same way;

dividing the first display electrodes into k (k≧2) groups by dividing the first display electrodes corresponding to the plural electrode unit pairs in the arrangement order by one unit;

applying a rectangular voltage pulse train having a constant period to the first display electrodes sequentially by one group while shifting the rectangular voltage pulse train by the time corresponding to a pulse width multiplied by 2/k so that the potential changes have a complementary relationship between the first display electrode units of the electrode unit pair; and generating a display discharge by applying another rectangular voltage pulse train similar to the rectangular voltage pulse train to the second display electrodes so that potential changes have a complementary relationship between the second display electrode units of the electrode unit pair and that the shift between neighboring first display electrodes becomes the time corresponding to a pulse width multiplied by 1/k.

8. The driving method according to claim 7, wherein a duty ratio of the rectangular voltage pulse train is 50%.

9. The driving method according to claim 7, further comprising the step of applying a sustaining voltage pulse having a larger pulse width than that of the rectangular voltage pulse train to the first display electrodes and the second display electrodes prior to the application of the rectangular voltage pulse train.

10. A display device comprising an AC type plasma display panel including a display screen in which first display electrodes and second display electrodes arranged in spaced relationship so as to form plural surface discharge gaps, corresponding to plural rows of a matrix display, and a relatively position relationship of first and second display electrodes defining neighboring rows, in a row arrangement direction, is opposite and respective terminals, connected to the first and the second display electrodes to supply electricity thereto, are located at respective, opposite sides of the display screen, wherein the first display electrodes are divided into plural pairs of first complementary display electrodes, each of the first complementary display electrodes being made up of one first display electrode adjacent only to one second display electrode;

the second display electrodes are divided into plural pairs of second complementary display electrodes, each of the second complementary display electrodes being made up of one second display electrode adjacent only to one first display electrode; and a driving circuit generates display discharges by changing potentials of the first and the second display electrodes so that a potential change has a complementary relationship between one first complementary display electrode and the other first complementary display electrode of a selected pair of complementary first display electrodes, for each of the first complementary display electrode pairs in succession, as well as between one second complementary display electrode and the other second complementary display electrode of a selected pair of complementary second display electrodes, in alternate succession with the first complementary display electrode pairs, for each of the second complementary electrode pairs, and that a sustaining voltage is applied to the surface discharge gap at the ratio of one row per k (k≧2) rows, and that the surface discharge gaps to which the sustaining voltage is applied are changed sequentially.

11. A display device comprising an AC type plasma display panel in which first display electrodes and second display electrodes are arranged so as to form surface discharge gaps for rows of a matrix display, and the position relationship between the first and the second display electrodes forming a surface discharge gap in the row arrangement direction is opposite between neighboring two rows, and terminals for supplying electricity to the first and the second display electrodes are divided into both sides of a display screen, wherein the first display electrodes are divided into k (k≧2) groups by making a unit of each of electrode arrays including the first display electrode neighboring only the second display electrode and the plural first display electrodes arranged without including a surface discharge gap and by dividing the first display electrodes in the arrangement order by one unit, and a driving circuit is provided for generating a display discharge by applying a rectangular voltage pulse train having a constant period to the first display electrodes sequentially by one group while shifting the rectangular voltage pulse train by the time corresponding to a pulse width multiplied by 2/k, and by applying another rectangular voltage pulse train similar to the rectangular voltage pulse train to the second display electrodes so that the shift between neighboring first display electrodes becomes the time corresponding to a pulse width multiplied by 1/k.

12. A driving method of an AC type plasma display panel including a display screen in which first display electrodes and second display electrodes arranged in spaced relationship so as to form plural surface discharge gaps corresponding to plural rows of a matrix display, and a position relationship, between the first and the second display electrodes corresponding to two arbitrary rows neighboring the former rows in a row arrangement direction is opposite between the two arbitrary rows, and respective terminals, connected to the first and the second display electrodes to supply electricity thereto, are located at respective, opposite sides of the display screen, the method comprising:

dividing the first display electrodes into plural pairs of first complementary display electrodes, each of the first complementary display electrodes being made up of the two first display electrodes arranged without a surface discharge gap therebetween;

dividing the second display electrodes into plural pairs of second complementary display electrodes, each of the second complementary display electrodes being made up of two second display electrodes arranged without a surface discharge gap therebetween; and generating display discharges by changing potentials of the first and the second display electrodes so that a potential change has a complementary relationship between one first complementary display electrode and the other first complementary display electrode of a selected pair of complementary first display electrodes, for each of the first complementary display electrode pairs in succession as well as between one second complementary display electrode and the other second complementary display electrode of a selected pair of complementary second display electrodes, in alternate succession with the first complementary display electrode pairs, for each of the second complementary electrode pairs and that a sustaining voltage is applied to the surface discharge gap at the ratio of one row per k ($k \geqq 2$) rows, and so that the surface discharge gaps to which the sustaining voltage is applied are changed sequentially.

* * * * *

UNITED STATES PATENT AND TRADEMARK OFFICE

CERTIFICATE OF CORRECTION

PATENT NO. : 7,116,288 B2
APPLICATION NO. : 09/885001
DATED : October 3, 2006
INVENTOR(S) : Takashi Shiizaki et al.

It is certified that error appears in the above-identified patent and that said Letters Patent is hereby corrected as shown below:

Title page, Column 2 (Abstract), Line 1, after “having” delete “a”.

Signed and Sealed this

Twentieth Day of February, 2007

JON W. DUDAS
*Director of the United States Patent and Trademark Office*